US005813134A

United States Patent [19]

Min et al.

[11] Patent Number: 5,813,134

[45] Date of Patent: Sep. 29, 1998

[54] APPARATUS AND METHOD FOR DRYING OR CURING WEB MATERIALS AND COATINGS

[75] Inventors: Kyung Min, Mentor; John E. Johansen, Ashtabula, both of Ohio

[73] Assignee: Avery Dennison Corporation, Pasadena, Calif.

[21] Appl. No.: 763,748

[22] Filed: Dec. 11, 1996

Related U.S. Application Data

[62] Division of Ser. No. 540,096, Oct. 6, 1995, Pat. No. 5,659, 972.

[51] Int. Cl.[6] ..... F26B 3/34

[52] U.S. Cl. ..... 34/255; 34/629; 34/640

[58] Field of Search ..... 34/641, 643, 629, 34/422, 255, 640

[56] References Cited

U.S. PATENT DOCUMENTS

| | | | |
|---|---|---|---|
| 2,676,416 | 4/1954 | Calosi et al. | 34/255 |
| 3,629,948 | 12/1971 | Hilton et al. . | |
| 3,722,105 | 3/1973 | Marteny | 34/254 |
| 3,992,144 | 11/1976 | Jackson | 8/490 |
| 4,151,387 | 4/1979 | Peters, Jr. | 219/10.49 |
| 4,257,167 | 3/1981 | Grassman . | |
| 4,499,358 | 2/1985 | Scott | 219/10.77 |
| 4,638,571 | 1/1987 | Cook | 34/255 |
| 4,932,140 | 6/1990 | Lepisto | 34/641 |
| 4,943,475 | 7/1990 | Baker et al. | 442/71 |
| 5,014,447 | 5/1991 | Hagen | 34/156 |
| 5,024,004 | 6/1991 | Jaeger . | |
| 5,064,979 | 11/1991 | Jaeger | 219/10.55 |
| 5,086,570 | 2/1992 | Matheus . | |
| 5,134,788 | 8/1992 | Stibbe et al. | 34/524 |
| 5,440,137 | 8/1995 | Sowers | 250/504 R |
| 5,605,607 | 2/1997 | LaRose et al. | 204/164 |

FOREIGN PATENT DOCUMENTS

| | | |
|---|---|---|
| 0094825 | 11/1983 | European Pat. Off. . |
| 272854 | 6/1988 | European Pat. Off. . |
| 1490332 | 11/1977 | United Kingdom . |

*Primary Examiner*—Henry A. Bennett
*Assistant Examiner*—Pamela A. Wilson
*Attorney, Agent, or Firm*—Renner, Otto, Boisselle & Sklar, P.L.L.

[57] ABSTRACT

A radio frequency (RF) assisted flotation air bar dryer apparatus and method for drying and/or curing a traveling web includes RF generating means for delivering RF through field and RF stray field to the web to heat the web, air bars to direct air flow to the web for cooling to facilitate emission of moisture therefrom and to avoid blistering due to overheating, an RF field reflector to reflect RF energy to the web, and a control system to monitor and to control air temperature and/or flow, RF field strength, and/or web temperature to maintain a balance between heating and cooling to obtain efficient high speed drying while avoid damage to the web.

37 Claims, 9 Drawing Sheets

APPARATUS AND METHOD FOR DRYING OR CURING WEB MATERIALS AND COATINGS

This is a division of originally application Ser. No. 08/540,096, filed on Oct. 6, 1995, now U.S. Pat. No. 5,659,972, issued Aug. 26, 1997.

FIELD OF THE INVENTION

The present invention relates generally, as is indicated, to apparatus and method for drying or curing web materials and coatings, and, more particularly, to the combined usage of electromagnetic energy and flowing fluid for drying and/or curing.

BACKGROUND

In the process of making a web, such as a paper web or a web made of a plastic or plastic-like material, the web is moved through a dryer in which the web itself is dried or cured and/or a coating or other material which has been applied to, imbibed in, etc. the web material is to be dried or cured. Drying usually is referred to as the removing of moisture, such as water, solvent or another ingredient, e.g., by evaporation, from the web, coating, etc. Curing usually refers to the carrying out of a chemical reaction. However, drying and curing are used herein in the broadest sense; and for brevity the term drying will be used below inclusive also of curing. Also, for brevity reference herein to drying a web includes drying the web itself and/or a coating thereof.

The line speed at which emulsions, which are coated on a web, can be dried during a web manufacturing process, for example, is limited by how quickly water can be removed from the emulsion coating (drying flux) and the length of the dryer apparatus (dwell time of the web in the dryer). Line speed increases are limited by drying flux capacity of the dryer to dry the web without damaging the web. Line speed increases could be achieved if the dryer were lengthened to provide the required dwell time to obtain desired drying. There are similar considerations for curing a web. However, there are some disadvantages in making a dryer longer, such as the need to increase the number of zones in the dryer, which adds to the size, complexity, difficulty of control, and expense of the dryer, additional air handling equipment, and a longer web path in the dryer apparatus. Also, a longer unsupported span of web in a dryer, between dryers or drying zones, etc. can increase the risk of web breaks, snags, and/or other web handling problems; and, therefore, the risk of loss of material and time delays due to shutdowns are increased. It would be desirable to increase the capacity of a web dryer apparatus by running that apparatus at faster line speeds without increasing the dryer length. Accordingly, and consistent with the invention as is described in detail below, it would be desirable to provide an emulsion drying method and apparatus in which the drying flux capacity is increased so that emulsion coatings can be dried in a shorter dwell time in the dryer.

Some prior web dryers have used an air flotation technique to dry a web passing through the dryer. The air flotation oven dryer apparatus usually includes several air bars or nozzles located, respectively, facing opposite surfaces of the web. The web is moved along its path through the dryer, and heated air is blown toward the surfaces of the web by respective air bars. The air usually is heated to facilitate drying the web.

Blowing heated air toward the surfaces of a web, though, has been found to be relatively inefficient to dry a web. For example, the process of heating air is a relatively inefficient one, and the transferring of thermal energy to the web by air also is relatively inefficient. Also, the enthalpy of air is relatively low. However, it is desirable to heat the web to increase the drying flux and, therefore, the rate at which the material actually dries.

Several techniques have been used in the past to try to improve the drying flux and, therefore, to reduce the time required to dry a web. One technique was to design the air bars to direct air flow toward the web in a manner that creates an air foil effect to increase the wiping of the flowing air fluid against the web. Another technique was to direct the air flow from the air bars toward the web in several directions in order to create a somewhat turbulent flow at the web to increase the wiping of the air against the web and the transfer of thermal energy to the web. The air bars usually had to be relatively close to each other to get sufficient thermal energy transfer for drying, and the air bars themselves were relatively narrow in length dimension (direction of belt travel) to concentrate hot air toward/at the web without losing heat to the surrounding environment. The larger the number of air bars, though, the more expensive is such a prior air floatation dryer, and the more distortions are applied to the web, which possibly could cause damage to the web. Also, when the air bars are spaced more closely, the air flow is limited because there must be sufficient space to remove the exhaust air. Still further, with the air bars positioned close to each other, there may not be adequate room to locate electrodes for developing and applying RF field to the web.

Another disadvantage to the drying of a coating, such as an emulsion, on a web using the air flotation oven technique is that the coating surface tends to dry faster and to become hotter than the subsurface coating material, and the dry surface may become fused and/or difficult for subsurface moisture to penetrate and to escape to the external environment. Therefore, careful consideration must be given to controlling drying to take into account the moisture concentration profile in the coating material to achieve drying of the entire coating, not just the surface portion thereof. Such consideration may result in the reduction of the temperature of the air directed to the web, but the reduced temperature results in a smaller drying flux and reduced drying rate, which can slow the drying process or can require an increase in the path length of the web in the dryer.

Another technique for drying a coating on a paper web includes the directing of a stray field of radio frequency (hereafter abbreviated "RF") electromagnetic energy provided, for example, at from about 10 MHz to about 100 MHz to the web. Stray field electrodes are used to provide the stray field which heats the coating to cause drying. The web is supported relative to the electrodes by a flow of hot air which also removes steam clouds produced by the high-frequency RF energy stray field drying process. The air flow is provided via air bars which also may serve as electrodes to provide the RF stray field. However, a problem that can occur using such stray field drying process is blistering of the coating, which can occur when the coating becomes too hot while drying as it is exposed to the high-frequency electromagnetic energy and hot air. A web with a blistered coating usually is an unacceptable product. It would be desirable to use RF drying while avoiding such blistering or other heat damage to a web.

Blistering is one example of a defect caused in the coating during drying. Blistering may occur for several reasons. For example, if the temperature of the coating is raised too high or too fast, blistering may occur; or it may occur due to the formation of a skin on the coating which blocks release of subsurface moisture. It would be desirable to dry a web while minimizing defects, such as defects in the coating, e.g., blistering, and especially to effect such relatively defect-free drying at a relatively fast rate.

The invention is described below by way of example with respect to the drying of an emulsion type of coating on a paper web. In the drying process moisture, e.g., water, contained in the emulsion is removed from the emulsion. The result may be substantially all moisture being removed or only some of the moisture being removed, depending on the product. It will be appreciated that the moisture also may be removed from a coating that is other than an emulsion and that the moisture may be removed from the web itself. The coating may be on one or both surfaces of the web or the coating may be imbibed or otherwise in a sense absorbed in or carried by the web. In one example the web is paper, but it will be appreciated that the web may be of another material, such as a plastic or plastic-like material. The ingredient removed during the drying process may be a material other than or in addition to water. One example is a solvent. Another example is a carrier fluid. Also, the invention may be used to cure a material rather than or in addition to the drying of the material.

The invention may be used to provide air flow or the flow of some other fluid with respect to the web. The other fluid may be a gas or a liquid, depending on circumstances, such as characteristics of the web and/or coating, whether the gas is to participate in a chemical reaction, such as part of the curing process, etc. For brevity, though, the fluid flow will be described below by way of example as an air flow.

The invention directs electromagnetic energy with respect to the web. The electromagnetic energy may be in the radio frequency (RF) spectrum or wavelength range. If desired, the electromagnetic energy may be in another range, such as that of microwave energy. Reference herein to RF energy includes all such electromagnetic energy capable of contributing to drying or curing as is described herein. Additionally, the electromagnetic energy may be directed to the web as a stray field, through field or both.

With the foregoing in mind, then, it would be desirable to increase the speed of the apparatus and process for drying a web to increase the web throughput while avoiding damage, such as that due to blistering. It also would be desirable to be able to optimize the travel speed of a web in a dryer to reduce time spent in the dryer or in drying the web and to reduce the energy required to dry the web. It also would be desirable to be able to detect conditions related to the drying of a web to achieve the foregoing to facilitate accommodating webs and/or coatings of different materials, size or other parameters, etc.

Conventional air floatation dryers use heated air both to heat the web and/or coating and to remove moisture emitted by the web and/or coating; thus, prior dryers use the heated air to provide both heat transfer and mass transfer. The present invention uses RF energy for heating and can use the air flow for mass transfer or for both heat transfer and mass transfer.

SUMMARY

According to one aspect of the invention, a method of drying and/or curing (reference to drying also, additionally or alternatively, may include curing as may be appropriate to the material being dried and/or cured) a web including a coating thereof (reference to drying a web may include the drying of a coating thereof drying of the web itself or both) includes directing a web along a sinusoidal path, the directing including directing a fluid flow (the fluid flow sometimes will be referred to as an air flow, but it will be appreciated that such reference may include the possibility that the fluid flow is a gas or liquid that is other than or is in addition to air) toward one surface of a web at two locations to urge the web in one direction and directing fluid flow toward an opposite surface of the web at a location between a pair of the first-mentioned locations to urge the web in a direction opposite such one direction, directing radio frequency (hereinafter sometimes referred to as "RF") energy toward the web, and controlling at least one of tension on the web and fluid flow rate(s) thereby to control the amplitude characteristic of the sinusoidal path and, thus, the direction in which and/or extent to which the RF energy impinges on the web.

Sinusoidal path may mean a path that may be generally of a sine wave shape or more broadly is an undulating, wavy, up and down, back and forth, etc. path. Also, the fluid flow is mentioned as directed at a surface of the web; the actual surfaces may not necessarily be opposite ones provided the sinusoidal path is obtained when desired.

Another aspect relates to apparatus for drying a web including means for directing a web along a sinusoidal path, the directing means including means for directing air flow toward one surface of the web at two locations to urge the web in one direction and means for directing air flow toward an opposite surface of the web at a location between a pair of the first-mentioned locations to urge the web in a direction opposite such one direction, means for directing RF energy toward the web, and means for controlling at least one of tension on the web and air flow thereby to control the amplitude characteristic of the sinusoidal path and, thus, the direction in which the RF energy impinges on the web.

According to another aspect, a method of drying a web includes directing RF energy relative to a web causing heating, and directing a fluid flow with respect to the web to balance the heating rate and the heat removal rate with respect to the web.

Another aspect relates to an apparatus for drying a web including means for directing electromagnetic energy relative to a web causing heating and means for directing a fluid flow with respect to the web to balance the heating, e.g., heating rate and the heat removal, e.g., heat removal rate relative to the web.

According to another aspect, a method of drying a web includes directing RF energy relative to a web primarily for heating, and directing a fluid flow with respect to the web primarily to remove moisture emitted from the web due to such heating.

According to another aspect, a method of drying a web includes directing RF energy relative to a web primarily for heating, and directing a fluid flow with respect to the web primarily to remove moisture emitted from the web due to such heating and to balance the heating rate and the heat removal rate with respect to the web.

Another aspect relates to an apparatus for drying a web including means for directing electromagnetic energy relative to a web primarily for causing heating and means for directing a fluid flow with respect to the web primarily to remove moisture emitted from the web due to such heating.

Another aspect relates to an apparatus for drying a web including means for directing electromagnetic energy relative to a web primarily for causing heating and means for directing a fluid flow with respect to the web primarily to remove moisture emitted from the web due to such heating and to balance the heating, e.g., heating rate and the heat removal, e.g., heat removal rate relative to the web.

According to another aspect, a method of drying a web includes directing an electromagnetic energy field with respect to the web, either as a through field, stray field, or both, and directing an air flow to the web to provide cooling to prevent, for example, overheating of the web.

According to another aspect, an apparatus for drying a web includes means for directing an electromagnetic energy field with respect to the web, either as a through field, stray field, or both, and means for directing an air flow with respect to the web to cool the web.

According to another aspect, a method of drying a web includes directing energy relative to a web to provide both an RF through field and an RF stray field, and directing a fluid flow with respect to the web to balance the heating rate and heat removal rate of the web in order to effect such drying without damaging the web, for example, due to overheating.

Another aspect relates to apparatus for drying a web including means for directing energy relative to a web to provide both an RF through field and an RF stray field, and means for directing a flow of fluid with respect to the web to balance the heating rate -of the web and the heat removal rate to permit drying without damage, for example, due to overheating.

Another aspect relates to a method of drying a web including directing RF energy with respect to the web to effect heating and, thus, drying and initially inhibiting film formation at the surface so moisture can exit the web at least during the initial part of the drying process.

Another aspect relates to apparatus for drying a web including means for directing RF energy with respect to the web to effect heating and, thus, drying and means for initially inhibiting film formation at the surface so moisture can exit the web at least during the initial part of the drying process.

Another aspect relates to a method of drying a web including directing RF energy with respect to the web to effect heating and, thus, drying and initially inhibiting film formation at the surface by directing fluid flow with respect to the web to maintain a relatively low surface temperature so moisture can exit the web at least during the initial part of the drying process.

Another aspect relates to apparatus for drying a web including means for directing RF energy with respect to the web to effect heating and, thus, drying and means for directing fluid flow with respect to the web to maintain a relatively low surface temperature initially to inhibit film formation at the surface so moisture can exit the web at least during the initial part of the drying process.

Another aspect relates to an air bar for directing air flow with respect to a web in a drying apparatus in which RF energy also is directed with respect to the web, the air bar having smooth surfaces and smoothly curved corners to tend to avoid arcing, at least part of the air bar being electrically conductive and serving as an electrode in an RF energy circuit.

Another aspect relates to a method for drying a web including directing RF energy from an electrode to a web and reflecting RF energy to the web.

Another aspect relates to an apparatus for drying a web including means for directing RF energy directly to a web and compression means for reflecting RF energy to the web.

Another aspect relates to a method for drying a web including directing RF energy and air to a web to effect drying thereof, sensing the RF energy, and controlling at least one of the RF energy and the air based on such sensing.

Another aspect relates to an apparatus for drying a web including means for directing RF energy to a web, means for directing air to the web, means for sensing the RF energy, and control means for controlling at least one of the RF energy and the air based on the sensed RF energy.

Another aspect relates to a system for supplying RF energy to a dryer for drying a web including electrodes for providing RF energy to a web, oscillator means for delivering electrical energy to the electrodes, sensor means for sensing the RF energy provided to the web, and feedback control means for controlling the RF energy delivered by the electrodes based on the level of RF energy sensed by the sensor means.

Another aspect relates to a method for drying a coating of a web moving through a dryer including directing RF energy to the web to cause moisture to leave the coating to provide mass transfer flux greater than about 5 grams per square meter per second and directing air flow with respect to the web to provide an air flux greater than about 40 ACFM/sq. ft. on each side of the web sufficiently to cool the web to avoid blistering from the heat and to carry released moisture away from the web.

Another aspect relates to the drying of a web by moving the web through a plurality of drying zones, and at a plurality of such zones directing both electromagnetic energy and air flow with respect to the web to effect drying of the web while avoiding blistering.

Another aspect relates to an arrangement of air bars in a radio frequency assisted flotation air bar apparatus for drying a traveling web wherein the air bars provide a sinusoidal flotation of the web for good web handling, and wherein the air bars are electrically grounded for RF field application, the RF field being radiated by separate electrodes.

Another aspect relates to a radio frequency assisted flotation air bar apparatus for drying a traveling web wherein a combination of RF electrodes and air bars provides both stray field and through field RF electromagnetic energy with respect to the web.

Another aspect relates to providing on-line RF field detection inside a radio frequency flotation air bar drying and curing apparatus for a traveling web to measure RF field strength inside the drying chamber on-line and to use the monitored information to provide feedback control of field strength, web speed, air temperature, etc.

Another aspect relates to apparatus for drying/curing a web including a coating thereof, including a sinusoidal path along which a web is directed, a source of fluid directed toward one surface of a web at two locations to urge the web in one direction and toward an opposite surface of the web at a location between a pair of the first-mentioned locations to urge the web in a direction opposite such one direction, an RF energy source directing RF field with respect to the web to provide RF stray field and/or RF through field, and the source of fluid including flow directors including air bars having a length dimension in direction of web travel on the order of from about 3.4 inch to about 5.25 inches.

Another aspect relates to apparatus for drying/curing a web including a coating thereof, including a sinusoidal path along which a web is directed, a source of fluid directed toward one surface of a web at two locations to urge the web in one direction and toward an opposite surface of the web at a location between a pair of the first-mentioned locations to urge the web in a direction opposite such one direction, an RF energy source directing RF field with respect to the web, and the source of fluid including air bars having a spacing between air bars on same side of web on the order of at least about 20".

Another aspect relates to apparatus for drying/curing a web including a coating thereof, including an RF energy source directing RF field with respect to a web, including a through field and a stray field, and a source of fluid flow directed with respect to the web to prevent blistering.

Another aspect relates to an air bar for a web drying/curing apparatus, including a housing means for receiving input air flow, an outlet means for distributing the air flow with respect to a web, and curved surface means at the intersections of respective walls of the air bar to avoid arcing when used as an electrode in an RF circuit to provide a through field and/or a stray field with respect to the web.

Another aspect relates to apparatus for drying/curing a web, including an RF energy source directing RF energy directly to a web, and a compression plate reflector reflecting RF energy to the web.

Another aspect relates to apparatus for drying/curing a web including a coating thereof, including an RF energy source directing RF energy to a web, a fluid source directed to the web to remove moisture emitted from the web and/or to cool or to balance temperature of the web due to heating by the RF energy, a sensor sensing RF energy, and a control for at least one of the RF energy and the fluid based on the sensed RF energy.

Another aspect relates to a system for supplying RF energy to an oven for drying/curing a web, including electrodes delivering RF energy to the web, an oscillator providing oscillating electrical energy to the electrodes, a rectifier delivering rectified electrical energy to the oscillator, an RF energy sensor sensing the RF energy delivered to the web, and a feedback control controlling the RF energy delivered by the electrodes based on the level of RF energy sensed by the sensor.

Another aspect relates to an improved RF field detector for detecting RF field.

Another aspect relates to a method of drying a web having a coating, comprising drying the coating on the web to provide a peak drying flux of about 3.8 $gm/m^2/sec$ or greater such that the coating is substantially free of defects due to drying.

Another aspect relates to a method of drying a web having a coating, comprising drying the coating on the web to provide an average drying flux of greater than about 1½$gm/m^2/sec$ such that the coating is substantially free of defects due to drying.

Another aspect relates to a high speed method of drying a web including a coating, comprising applying the coating to the web such that the dried coating thickness is from about 1 micron to about 130 microns, drying the web such that the peak drying flux is at least 3.8 $gm/m^2/sec$ and the dried coating is substantially defect free.

Another aspect relates to a method of making a coated web, comprising coating a web with a water based coating or a solvent based coating that is polar in nature or has polar additives responsive to RF energy to undergo heating, and drying the coating to provide a peak drying flux of about 3.8 $gm/m^2/sec$ or greater and such that the coating is substantially free of defects caused by the drying.

Another aspect relates to a method of drying a web having a coating, comprising drying the coating on the web by moving the web through a dryer at a rate of from about 1,000 feet per minute to about 2,000 feet per minute such that the coating is substantially free of defects due to drying.

Another aspect relates to a method of drying a web having a coating, comprising drying the coating on the web by moving the web through a dryer that is about 120 feet in length at a rate of from about 1,000 feet per minute to about 2,000 feet per minute such that the coating is substantially free of defects due to drying.

Another aspect relates to a method of drying a web having a coating, comprising moving the web through a dryer while applying to the web RF flux from about 1 $KW/m^2$ to about 50 $KW/m^2$ such that the coating is substantially free of defects due to drying.

Other aspects of the invention relate to web products made in accordance with the respective methods and/or using the apparatus of the invention described above and elsewhere herein.

Using principles of the invention a number of advantages are obtained including, for example, faster running speed of an emulsion coated web through a dryer, faster heating for the emulsion coated web, and/or faster curing reaction for hydrosylation reaction of silicones in emulsion or reaction of dielectric reactants than was heretofore obtained.

To the accomplishment of the foregoing and related ends, the invention, then, comprises the features hereinafter fully described in the specification and particularly pointed out in the claims, the following description and the annexed drawings setting forth in detail certain illustrative embodiments of the invention, these being indicative, however, of but several of the various ways in which the principles of the invention may be suitably employed.

Although the invention is shown and described with respect to one or more preferred embodiments, it is obvious that equivalents and modifications will occur to others skilled in the art upon the reading and understanding of the specification. The present invention includes all such equivalents and modifications, and is limited only by the scope of the claims.

DESCRIPTION

Figure 1:
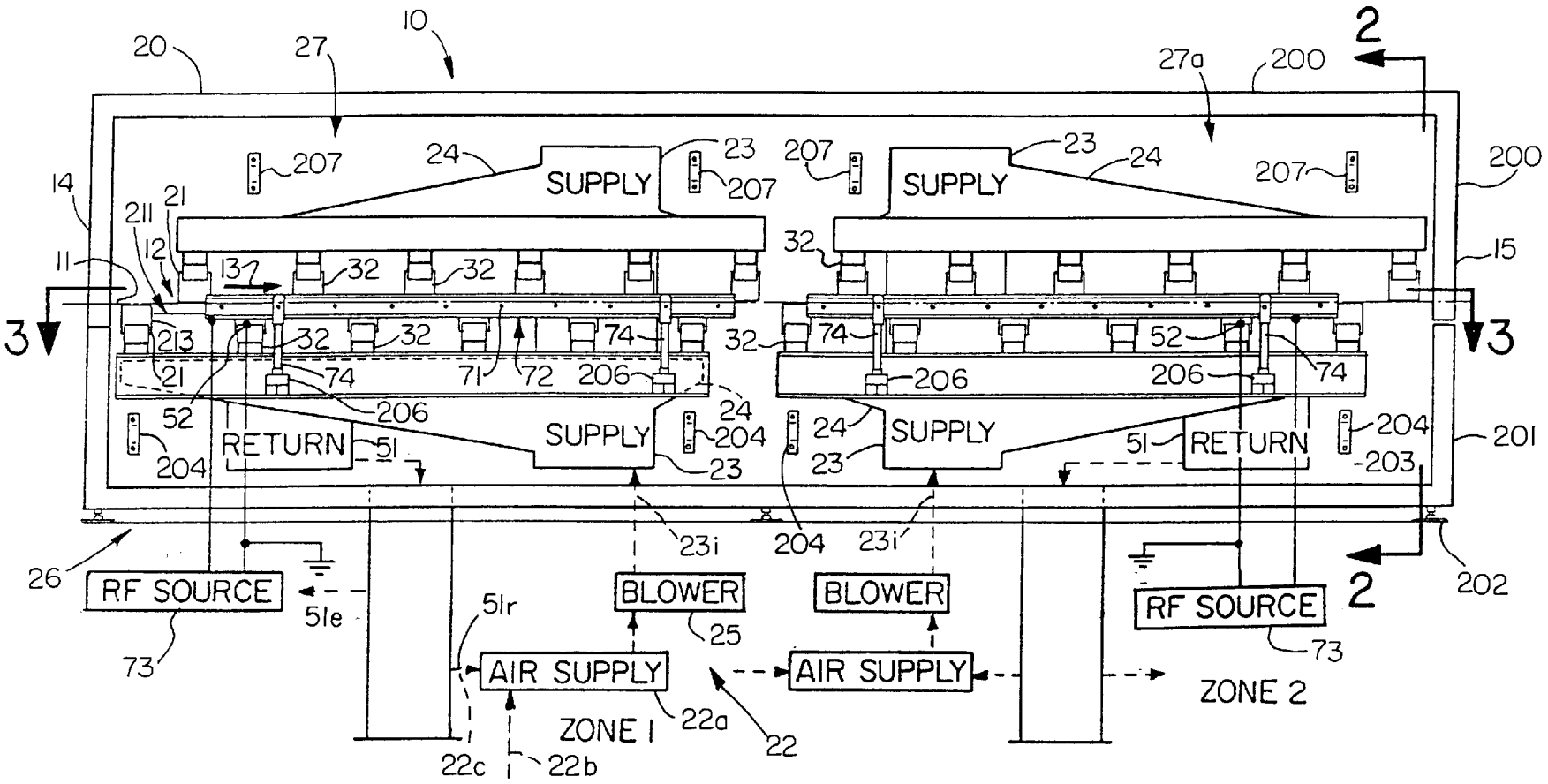
FIG. 1 is a schematic side elevation view of a dryer apparatus for drying or curing web materials and coatings in accordance with the present invention.
Figure 2:
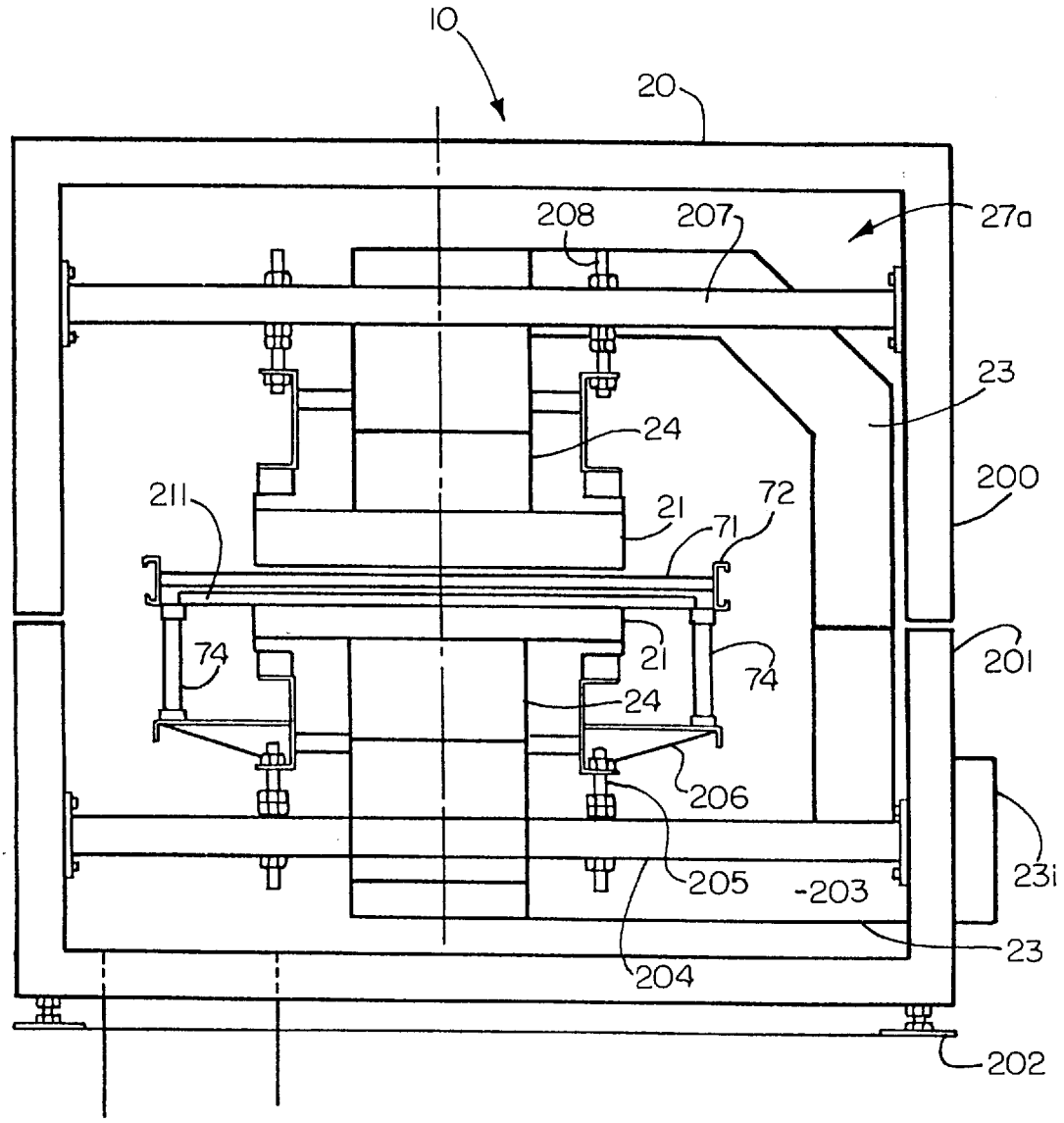
FIG. 2 is an end view of the dryer of FIG. 1 looking generally in the direction of the arrows 2—2 from the right end of FIG. 1.
Figure 3:
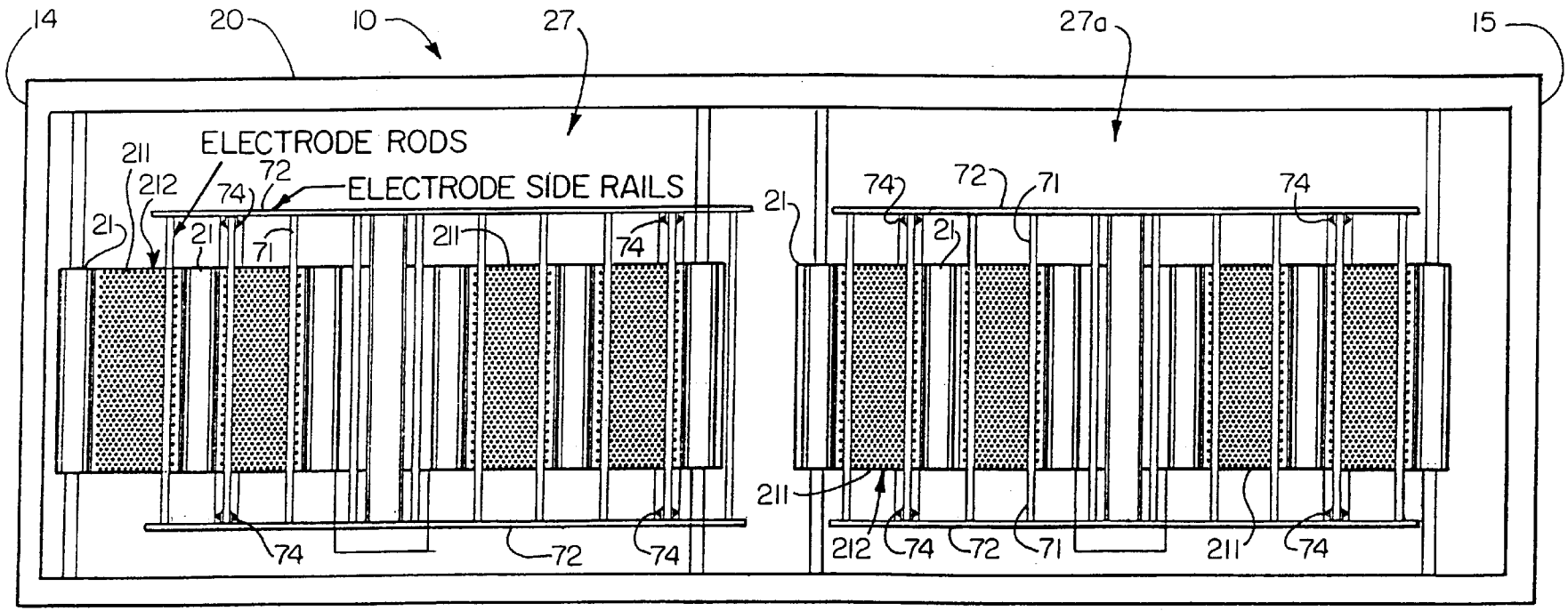
FIG. 3 is a partial top view of the dryer looking generally in the direction of the arrows 3—3 of FIG. 2.

Referring, now, in detail to the drawings, wherein like reference numerals designate like parts in the several figures, and initially to FIGS. 1–3, a radio frequency (RF) assisted flotation air bar dryer apparatus for drying and/or curing a traveling web is generally indicated at 10. The dryer 10 is described below by way of example as being used to dry a water-containing or wet emulsion coating that is on a paper web 11 which is carried along a path 12 through the dryer 10 in the direction of an arrow 13 from an entrance end 14 to an exit end 15 of the dryer. The dryer may be used to dry or to cure other webs and/or coatings.

Summarizing exemplary operation of an embodiment of dryer 10 to dry a web, RF energy heats the web and/or coating. Air flow from air bars removes moisture that is emitted from the heated web and/or coating. The air flow also may balance temperature of and/or cool the web and/or coating to avoid blistering or other heat damage.

Conventional drive rolls, idler rolls, supply rolls and take up rolls (not shown) may be used to supply the web 11 to the dryer 10, to pull the web through the dryer, and to store the web or otherwise to direct the web for further processing after exiting the dryer. Coating equipment may be used to apply a coating to the web 11 upstream of the entrance end 14 of the dryer 10.

Within the dryer housing 20 are a plurality of air bars, nozzles or air outlets 21 which direct air flow toward the web 11 to support the web along the path 12 through the dryer 10. In the illustrated embodiments hereof there are a plurality of air bars 21 on each side of the web 11, e.g., above and below the web relative to the illustration of FIGS. 1 and 2. (Directions referred to herein are generally for the purpose of facilitating description, but it will be appreciated that the various positional and functional relationships of the components described may be maintained with respect to each other while in a different orientation or location relative to the illustrations in the drawings. For example, web travel may be vertical in which case the air bars may be on opposite sides of the web in relative left-hand and right-hand relation to the web rather than being above and below the web, and so forth.)

The air bars 21 are provided with a supply of air from an air supply system 22, which includes an air source 22*a*, an air supply duct 23, a plenum or header 24 and a blower 25. The air source for air supplied to the blower may be, for example, fresh air 22*b*, air recirculated 22*c* from the dryer or a combination thereof. The blower 25 may provide such air under suitable pressure and volume to obtain desired air flow from the air bars with respect to the web 11. Air flow is directed from the blower 25 via the plenum or header 24 (referred to below as "plenum" for brevity) to the air bars 21. The air bars are constructed and arranged to direct air flow with respect to the web to support the web and to direct the web in a generally sinusoidal path 12. The amplitude of each "hump" or half wave of the sinusoidal path followed by the web 11 may be determined by the tension on the web caused by the conventional rolls, drive(s), and/or other equipment delivering the web into the entrance end 14 of the dryer 10 and taking up the web out from the exit end 15 of the dryer. That amplitude also may be determined by the velocity or force and the direction that the air is directed by the respective air bars 21 against and/or toward respective surfaces of the web. Such amplitude also may be determined by the density of the air directed by the air bars with respect to the web; for example, warm air is less dense than cold air.

In the described embodiment the fluid medium delivered by the air bars 21 is air. However, it will be appreciated that other fluid medium may be used instead of or in addition to air. One example is an inert gas. Other liquid, gas, mixture, or other fluid media also may be used. Also, as was mentioned above, the path 12 preferably is undulating and, for example, somewhat sinusoidal in shape. However, the path 12 need not be a true sinusoidal wave shape; it may be other shape, as may be desired.

The dryer 10 also includes an electromagnetic energy system 26 which provides electromagnetic energy to the web. In the embodiment described in detail here the electromagnetic energy is radio frequency (RF) energy, i.e., electromagnetic energy that is in the radio frequency wavelength or frequency range. However, if desired, electromagnetic energy that is other than or in addition to RF energy may be used; one example is microwave energy.

The electromagnetic energy system 26 directs an RF electromagnetic energy field (sometimes referred to as a RF field) with respect to the web 11. The RF field causes oscillatory movement of both water molecules and latex particles in the emulsion coating of the web and, therefore, the heating of the emulsion coating and the faster diffusion of moisture therefrom. Since the RF field usually can penetrate throughout the coating (and possibly the web), a fast moisture diffusion ordinarily will occur throughout the coating (and web), resulting in a fast moisture removal at the surface.

Reference is made herein to flux of various types, such as heat transfer flux, mass transfer flux and RF flux. Flux is considered here, for example, as a rate per unit surface area. For example, heat transfer flux, which also is referred to herein as drying flux, may be considered a rate of heat transferring per unit surface area with units of calorie/square meter-second. As another example, mass transfer flux may be considered a rate of mass transferring per unit surface area with units of grams/square meter-second. Similarly, RF flux may be considered as a rate of RF energy transferring into web material per unit surface area with units of calorie/square meter-second or KWH/square meter-second (where KWH is kilowatt hours); alternatively the RF flux may be expressed in KW/square meter (where KW is kilowatts).

RF flux also may be considered the rate of RF energy transferring into web material per unit surface area with units of KW/square meter, where the RF energy includes both the RF energy used for dielectric heating the web materials and the energy loss due to converting of the RF power from the DC power circuit from which the RF energy is developed.

In an exemplary embodiment of the present invention the RF flux has a loss portion of about 40% and an RF heat generation portion of about 60% from a total DC power supply.

In an exemplary embodiment of dryer apparatus 10 and method in accordance with the invention a 27 inch wide web is moved through a two zone dryer, each zone being about 10 feet in length, at a line speed of about 222 fpm (feet per minute). The web surface area in each zone is about 2.09 square meters (22.5 square feet). In the first (upstream relative to web travel direction) and second (downstream) zones the air temperature is about 140° F. and 190° F., respectively; the nozzle air velocity from the air bars is about 8,000 fpm; the RF DC voltage is about 10 KV and 6.9 KV, respectively; and the DC plate current is about 5 amps and 0.8 amps, respectively. From the above information the RF flux in the first zone is calculated as 10 KV×5 amps/2.09 square meters=23.9 KW/square meter; and in the second zone is calculated as 6.9 KV×0.8 amp/2.09 square meters= 2.64 KW/square meter.

In another exemplary embodiment of dryer apparatus 10 and method in accordance with the invention a 78 inch wide web is moved through a six zone dryer, each zone being about 20 feet in length, at a line speed of about 1,250 fpm. The first four zones include air bars but no RF energy source, application electrodes or the like; the fifth and sixth zones include RF energy source and electrodes to apply RF energy to the web in those zones as disclosed herein, for example. The web surface area in each zone is about 12.08 square meters (130 square feet). In the respective fifth and sixth zones the air temperature is about 140° F. and 147° F., respectively; the nozzle air velocity from the air bars is about 8,300 fpm and 8,500 fpm, respectively; the RF DC voltage is about 13 KV and 11 KV, respectively; and the DC plate current is about 18.5 amps and 15 amps, respectively. From the above information the RF flux in the fifth zone is calculated as 13 KV×18.5 amps/12.08 square meters=19.9 KW/square meter; and in the sixth zone is calculated as 11 KV×15 amp/12.08 square meters=13.7 KW/square meter.

In still another exemplary embodiment in which RF energy is applied to the web as in the preceding example for all six zones of the dryer 10, each zone being about 20 feet in length, the line speed for the web is about 1,500 fpm, and the RF flux for the fifth and sixth zones are about 5% to about 10% greater than the RF flux level of 20 KW/square meter; the other four zones are at about 50% lower RF flux than the RF flux at the fifth or sixth zone.

In another embodiment the RF flux in a particular drying zone is about 40 KW/square meter. Also, in another embodiment, it the RF flux may be less than 20 KW/square meter. The actual drying flux used may depend on characteristics of the web product and/or coating material being dried in the dryer.

In an embodiment of dryer 10 and method according to the invention the RF flux in one or more drying zones is from about 1 to about 50 $KW/m^2$.

In an embodiment of dryer 10 and method according to the invention the RF flux in one or more drying zones is from about 2 to about 40 $KW/m^2$.

In an embodiment of dryer 10 and method according to the invention the RF flux in one or more drying zones is from about 2 to about 24 $KW/m^2$.

In an embodiment of dryer 10 and method according to the invention the RF flux in one or more drying zones is from about 2 to about 20 $KW/m^2$.

A non-limiting example of a wet emulsion coating on a paper web is a coating that is about 50 microns thick having individual polymer particles that are of a size on the order of from about 0.01 micron to about 30 microns diameter. The RF field tends to penetrate and heat the coating substantially throughout the thickness thereof to cause moisture to diffuse out to the coating surface. The invention may be used to dry coatings having larger or smaller individual particle diameter.

The same effect of RF energy can be achieved for most of particulate systems such as (A) Micro-emulsion coating having the particle size range between 0.01–0.05 micron in diameter; (B) Emulsion coating having typical particle size range between 0.08–0.8 micron in diameter; (C) Micro-suspension coating having the particle size range between 10–30 micron in diameter. RF energy can penetrate and heat these coatings very fast and thus cause moisture to diffuse out fast to the surface and subsequently the moisture on the surface can be mass-transferred out through turbulent air provided by air bars. A non-limiting exemplary emulsion with which the invention may be used according to an embodiment has a particle size range between 0.1–0.4 micron in diameter.

The air flow provided by the air bars 21 may have one or several functions. For example, the air flow may provide a cooling effect to cool the web and especially the coating to prevent blistering while the RF field is heating the coating and/or web to cause water to be emitted therefrom. Providing such cooling effect helps to assure that a skin does not form prematurely on the surface of the coating and block water emission from the coating. Another advantage to using air flow for cooling rather than heating the web is that energy does not have to be expended to heat the air, and efficiency is not lost by requiring air to heat the web. Rather, heating can be carried out solely, partly, or primarily by the RF field, which may couple energy to the web more efficiently than does an air flow.

If desired, the air flow may be used to heat the web 11 to assist in the heating function that also is carried out by the RF field. Also, the air may be heated while still providing a cooling or temperature balancing or maintaining function, as the RF energy provides heating; the air temperature may be less than the air temperature required in the past when the air was used as the primary source of heating.

The air flow also is used to carry moisture emitted from the coating of the web away from the web for disposal elsewhere.

The dryer apparatus 10 may be arranged in a single zone whereby the drying zone 27 is formed by a single group of air bars and one or more plenums 24, such as that depicted in the left hand portion of FIG. 1. If desired, though, the dryer 10 may include several zones, each of which effects drying in the same way or in different ways. For example, the drying zone 27 at the left hand side of FIG. 1 may provide drying function wherein the RF energy is at a particular level and desired heating or cooling is provided by the air flow from the air bars; and the RF energy and/or air temperature may be different at the drying zone **27*a* shown at the right-hand side of FIG. 1**.

Figure 4:
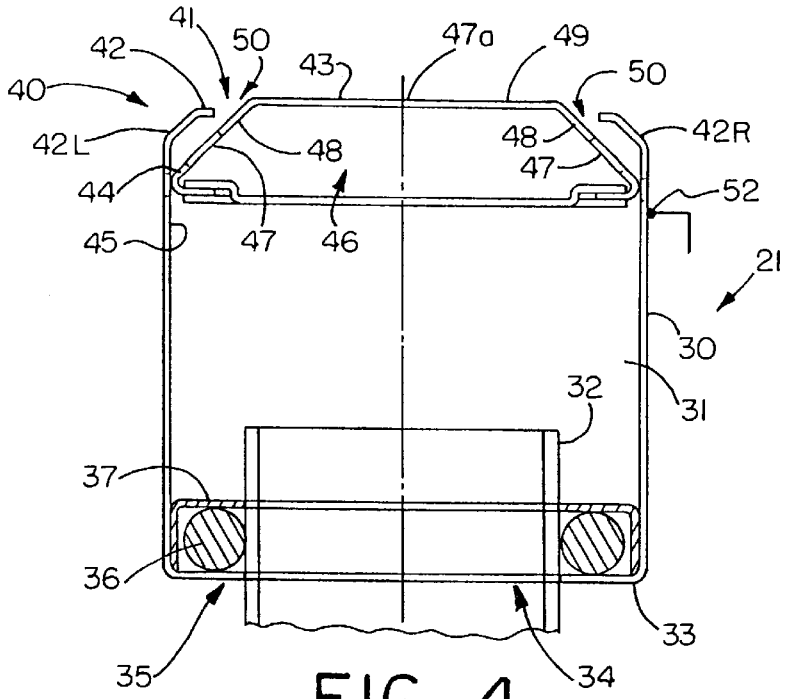
FIGS. 4 and 5 are side elevation section views of exemplary embodiments of air bar used in the dryer.

Referring to FIG. 4, one example of an air bar 21 is shown schematically in cross section. The air bar 21 includes a generally rectangular shape housing 30 which has an interior chamber or volume 31 into which air is directed under pressure from the plenum 24. The air bar housing 30 may be mounted on a support duct 32, which is attached to the plenum 24, and the housing 30 may be slid along the support duct 32 toward or away from the web path 12 to a desired location with respect thereto.

A wall 33 of the air bar housing 30 has an inlet opening 34 through which the support duct 32 enters the housing chamber 31 to direct air from the plenum into the chamber.

A seal assembly 35, such as an o-ring, packing or the like 36, cooperates with the housing 30, a seal retaining wall 37, and wall 33 to block air leakage from the chamber 31 out past the outside of the support duct 32. The seal assembly 35 provides a frictional fitting engagement with the support duct 32 so that absent an intentional adjusting of the position of the housing 30 on the support duct 32, such housing will remain in a relatively fixed position on the support duct. A screw or other fastener (not shown) also may be used to secure the air bar 21 in position on the support duct 32.

The outlet end 40 of the air bar housing 30 includes an outlet opening 41 in a wall or face 42 of the air bar 21 opposite the wall 33. The outlet opening 40 is partly blocked by a fluid directing outlet cap or deflector 43.

The housing 30 may be formed of sheet metal folded to the configuration shown in FIG. 4. In FIG. 4 the air bar is shown in a section end view; the width of the air bar into the paper of the drawing of FIG. 4 and into the paper of the drawing of FIG. 1 may be about the same as or longer than the maximum width of the web 11 so that air will be directed with respect to and across the entire width of the web as it passes the air bar. Air bar length may be considered in the direction of web travel. The actual direction of air flow and where it flows with respect to the web 11 may be from perpendicular to, at an acute angle to, substantially parallel or otherwise relative to the web. A change in the configuration of the outlet end 40, cap 43, etc. can be used, for example, to change the air flow direction(s). The outlet cap 43 may be folded sheet metal material in the shape shown in FIG. 4 or it may be otherwise formed. The outlet cap 43 is attached at corners 44, for example by welding, screw and nut connection, or friction fit, to walls 45 of the air bar housing 30.

The outlet cap 43 has an air distribution chamber 46 and one or more outlet passages 47. In the illustrated embodiment of FIG. 4 two of the air outlet passages 47 are in angled side walls 48 of the outlet cap 43, and one air outlet passage 47*a* is in the top wall 49 of the cap 43.

As is seen in FIG. 4, the cap wall 48 and the face wall 42 cooperate to form slot-like gaps 50 through which air flow exits the air bar 21 along the width thereof for impingement on the web 11. Since the air is not used primarily for heating of the web, but rather primarily is used to remove moisture emitted from the web, and/or to balance web temperature or to cool the web, as heating is carried out primarily by the RF energy, the size of the gaps 50, the spacing of the gaps in an air bar and, thus, the length of the air bar and size of the face 42, the spacing of the air bars from each other and/or the air flow velocity may be larger than in prior air floatation dryers.

In operation of the air bar 21, the housing 30 is adjusted to an appropriate location on the support duct 32 to place the outlet opening 41 of the air bar and cap 23 in a desired location relative to the web 11. Air from the supply 23 (FIG. 1) is delivered via the plenum 24 and support duct 32 into the air bar chamber 31. The air in the chamber 31 is under pressure so that it is forced into the air distribution chamber 46 of the outlet cap 43 and out through air outlet passages 47 to flow with respect to the web 11. In the illustrated embodiment air exiting the outlet passage 47*a* flows directly toward the web. Air exiting the outlet passage 47 is deflected by the angled face walls 42 to flow out through gaps 50 between the respective walls 42 and 48. The cooperative relation between various walls of the air bar 21 where the air flow exits can determine the direction of air flow, the extent that the air flow is turbulent or laminar, and to an extent the volume of the air flow. In the illustrated embodiment the air flow exiting the air bar 21 is directed with respect to the web in a direction toward the web, and that air flow is somewhat turbulent in order to achieve a wiping action with respect to the web for good thermal energy transfer between the air and the web. Such air flow also picks up the moisture emitted from the web to remove it from the presence of the web, especially as the air is withdrawn from the dryer housing 20 through an outlet 51 (FIG. 1).

The air bars 21 and air flow provided by the invention maintain a relatively high mass transfer rate to remove moisture from the area of the web. Also, since the primary heating is provided by RF energy, the air flow may not need to be used to provide heat transfer to the web; although, if desired, the air flow may provide such heat transfer and also may be used to provide cooling or balancing of temperature, e.g., to avoid blistering or other heat damage to the web. Thus, the invention provides drying of the coating while the coating is maintained substantially free of defects due to or caused by or in the drying process. In contrast, prior air floatation systems which used air bars relied on air flux to provide both heat transfer and mass transfer. In such prior systems the air bars were spaced relatively close together and the length of each, i.e, space between air outlet gaps, and gap size were relatively smaller than is possible in the present invention to maximize heat transfer and mass transfer. In the present invention larger faces 42, gaps 50, distance between gaps 50 permits a greater air flow per air bar than was possible in the past since the air flux may be used primarily for mass transfer and secondarily for heat transfer. Also, since there is a greater air flux per air bar 21 of the invention than in air bars used in prior air floatation dryers, there may be larger distance between air bars while still providing approximately the same air flux for mass transfer. The larger spacing between air bars reduces the complexity of the dryer, reduces the number of undulations of the web in its path 12 through the dryer, and permits greater flexibility in controlling the direction of the path, e.g., amplitude of the respective undulations than was possible in the past.

Several examples of air bar size and spacing are presented elsewhere herein. These are not intended to be limiting but rather are intended to demonstrate operation of the invention consistent with the description hereof.

Figure 5:
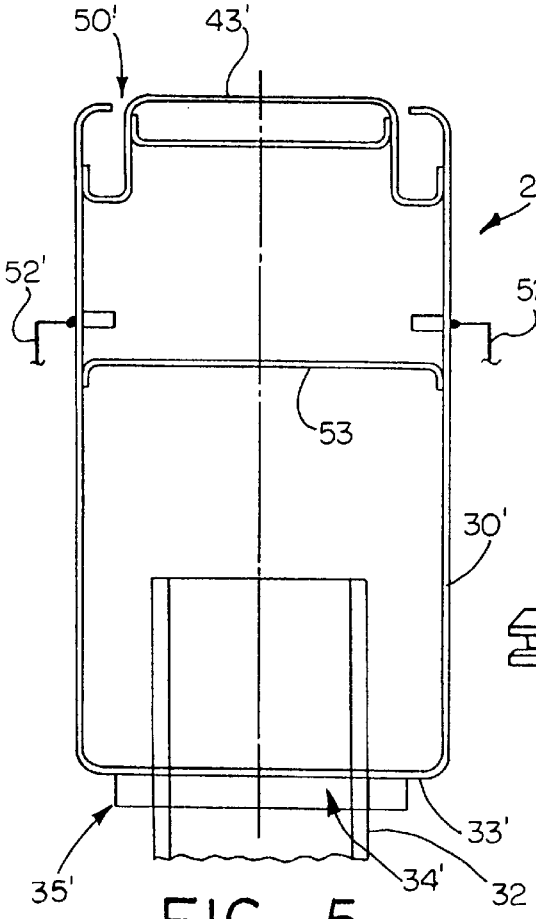

An example of an alternative form of air bar 21' is shown in FIG. 5. The air bar 21' is similar in function to the air bars 21 described elsewhere herein and similar parts are designated by the same reference numerals, except in FIG. 5 the reference numerals are primed. The air bar 21' has a relatively longer height dimension from the base wall 33' to the face wall 42'. At the base 33' is an opening 34' into which a riser support duct 32 of the plenum 24 extends to deliver air to the air bar. The air flows through the air bar 21' (vertically upward relative to the illustration of FIG. 5). The air flow is discharged out through gaps 50' in the face 42'. The gap 50' is on the order of about 0.159 inch, and such dimension provides a similar air flow result as that described above with respect to the air bars 21 in order to increase to more than twice the amount of air flow compared to the air flow of air bar configurations and uses in prior air floatation dryers. Several ribs 53 within the housing 30' of respective air bars 21' provide strengthening and rigidity for the air bar. Space between ribs allows substantially unimpeded air flow through the air bar. Also, the ribs 53 may provide a stop to limit the distance that a support duct 32 from the plenum 24 can protrude into the air bar.

The air bars 21 are used as electrodes in the electromagnetic energy system 26 of the dryer apparatus 10. Therefore, the air bars have electrically conductive characteristics. For example, the air bars 21 may be formed of aluminum, stainless steel or other electrically conductive material. Preferably the air bars are not formed of ferromagnetic material to avoid becoming magnetized. To avoid arcing, the front and back edges 42L, 42R e.g., the edges at the left and rights sides of the air bar illustrated in FIG. 4 near the outlet opening 41 and, if necessary, other edges should be rounded as much as possible, and the surface of each rounded edge should be as smooth as is reasonably possible. Also, any points of attachment by welding, fasteners (nuts, bolts, screws, etc.), or other means of attachment of each air bar, such as where the outlet cap 43 is attached to the housing 30, electrical connections 52, etc. should be deburred and smoothed to avoid sharp points, edges or surfaces where arcing might occur.

As is seen in FIGS. 1–7, the electromagnetic energy system 26 includes a plurality of electrodes 71 which are mounted in a frame 72 and are coupled to an RF power generator circuit 73. The RF generator circuit 73 may be shared by plural zones 27, 27*a*, etc., or a separate circuit 73 may be used for respective zones. The electrodes 71 may be metal tubes, such as aluminum or stainless steel tubes, rods, wires, or other electrodes. The frame 72 may be made of electrically conductive material, for example aluminum or other material, and it may serve as an electrical bus to supply electrical energy, such as an RF wave or signal, to the electrodes 71.

Figure 7:
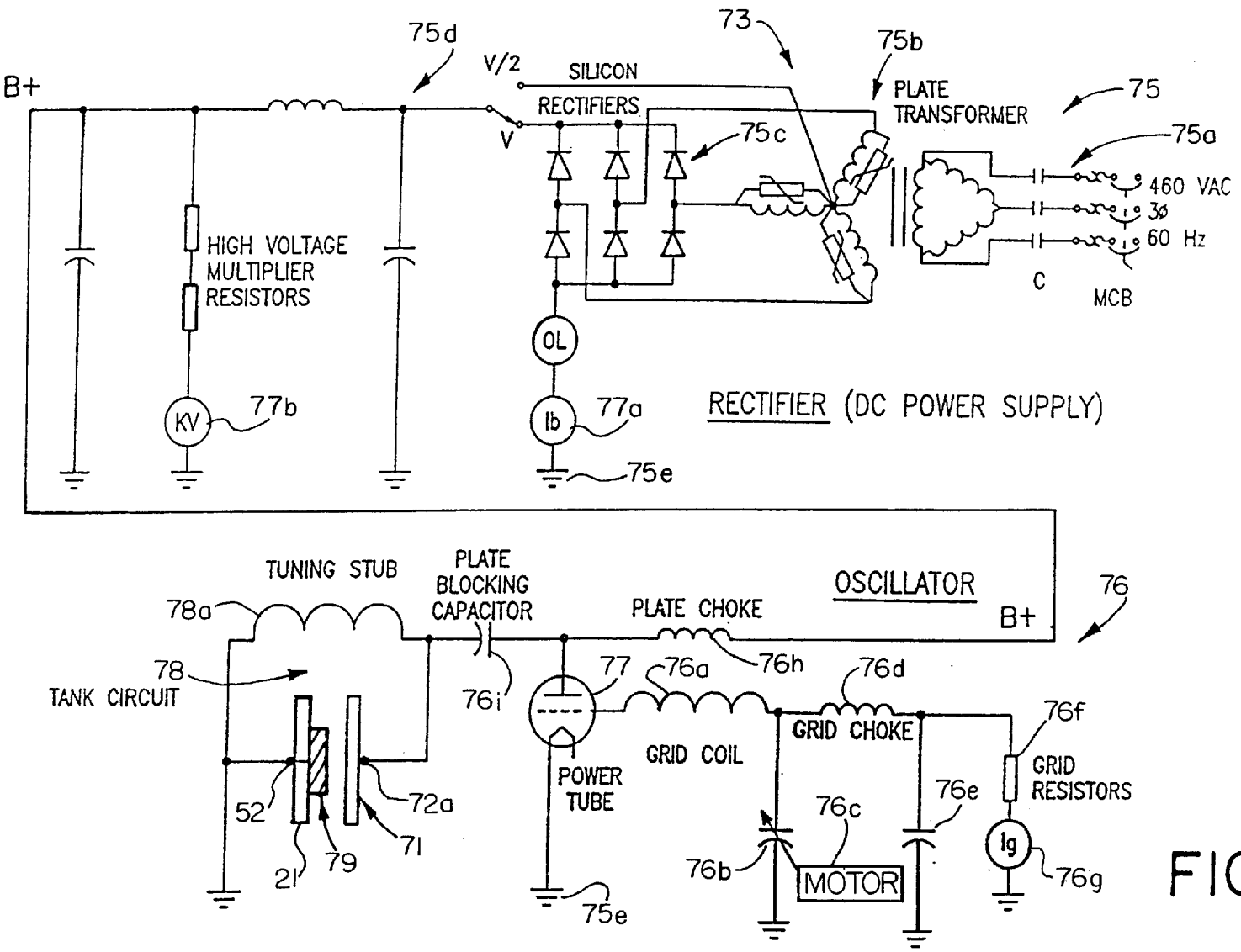
FIG. 7 is a schematic electric circuit diagram of an RF source.

As is shown in FIG. 7, the electrode bus frame 72 includes a pair of C-shape channels or elongate members 72*a*, 72*b*. These members may be made of aluminum plate bent with such C-shape or they may be of other suitable material to provide support for the electrodes 71 and preferably also to conduct electrical energy to the electrodes. The members 72*a*, 72*b* may be extruded or otherwise formed. The electrodes 71 are fastened at opposite ends to respective members 72*a*, 72*b* of the electrode bus frame 72 by an electrically conductive bolt 72*c*, for example of brass. The electrode bus frame 72 preferably is electrically conductive to supply RF wave (electrical/electromagnetic) energy to each electrode 71. Other means may be used to provide energy to the electrodes to produce a RF field output. The electrode bus frame 72 usually does not require electrical insulation since the RF wave can transmit and propagate out through insulating material (e.g., rubber) to a neighboring ground.

The frame 72 is supported in the dryer housing 20 by several insulating supports 74 (FIGS. 1–3), such as steatite insulator rod supports or other support structure. Preferably the supports 74 permit the adjusting of the position of the frame 72 and, thus, electrodes 71 in the dryer housing 20 to place the electrodes 71 at desired locations relative to the web path 12 and the air bars 21.

In operation of the electromagnetic energy system 26, the RF power generating circuit 73 supplies electrical energy to the electrodes 71 at such power and frequency to cause the radiating of an RF field with respect to one or several air bars 21, 21', which are grounded relative to the circuit 73. If desired, one or more air bars may be "hot" or ungrounded and one or more of the frame electrodes 71 may be grounded and appropriately electrically insulated from the electrode bus frame 72 and/or the other electrodes 71. However, it is preferred that the air bars are grounded to minimize other electrical insulation requirements of the dryer 10.

When an electrode 71 on one side of the web 11 directs an RF field to an air bar on the same side of the web, that RF field is referred to as a stray field. When the electrode 71 directs an RF field to an air bar on the opposite side of the web 11, the RF field is referred to as a through field. Usually a stray field tends to graze the web and does not deliver quite as much direct or concentrated energy to the coating as does a through field. Blistering of the coating may occur, for example, when the RF energy delivered to the coating is so great as to cause an excessive temperature of the coating. An RF stray field does not usually provide the most intense part of the field to the coating. Therefore, the likelihood of excessive heating of the coating and blistering is reduced when an RF stray field is used. Also, an RF stray field may be directed through a larger extent of the coating than an RF through field, and, therefore, such stray field may provide a more uniform heating effect over that extent.

The present invention also avoids the aforementioned blistering even though substantial electromagnetic energy can be delivered to the coating by stray field and/or through field because of the cooling air flow provided by the air bars 21 to avoid excessive temperature conditions that would cause blistering.

In FIG. 7 is a schematic circuit diagram of the RF source 73. The RF source 73 includes a DC power supply 75, and an oscillator 76. An exemplary DC power supply may include an AC input 75*a*, e.g., from a 460 volt, 3 phase, 60 Hz power source, which is transformer 75*b* coupled to a full wave rectifier 75*c* in turn coupled to a DC power output circuit 75*d*, which includes one or more capacitors, indicators and/or resistors, as well as other components, if necessary, to provide desired filtering, voltage multiplication, etc., as is known in the art of DC power supplies. Ground is designated 75*e*.

Figure 6:
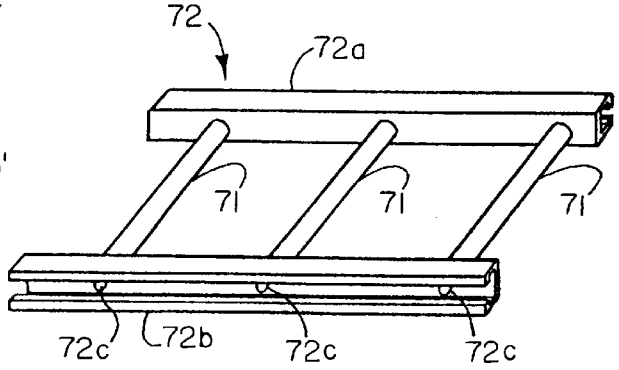
FIG. 6 is a schematic isometric illustration of an arrangement of electrodes and electrode bus frame used in the dryer.

The oscillator 76 shown in FIG. 6 includes a generator triode 77, a tank circuit 78, and associated circuitry. In one example, the generator triode 77 is model RS 3150 CJ sold by Siemens. Such generator triode is a metal-ceramic triode that is water cooled, and it is able to produce an output at frequencies up to about 100 MHz with oscillator power up to about 240 KW. Other generator devices also may be used as equivalent substitutes for the generator triode 77 to provide a suitable drive for the oscillator 76 to obtain the desired RF output from the RF source 73 for the purposes described herein.

The cathode of the generator triode 77 is coupled to ground. In the grid circuit of the generator triode 77 are a grid coil 76*a*; adjustable capacitor 76*b*, which is adjusted over its range of capacitance, for example, from about 25 pf to about 450 pf, by a motor 76*c*; grid choke 76*d*; capacitor 76*e*; and grid resistors 76*f*. A grid current meter 76*g* can measure and display (or feed back for control) information representing grid current. By adjusting the capacitor 76*b* operation of the generator triode 77 can be adjusted/controlled. The size range of adjustment for the capacitor 76*b* is exemplary; the range may be larger, smaller and/or may extend beyond one and/or the other exemplary boundary. Also devices other than a motor 76*c* may be used to adjust the capacitor, such as, for example, manual control, electronic control, etc.

The plate electrode of the generator triode 77 is coupled via a plate choke 76*h* to receive DC power from the DC power supply 75, and it is coupled via a plate blocking capacitor 76*i* to the tank circuit 78.

As is seen in FIG. 7, the tank circuit 78 includes the air bars 21 and the electrodes 71 which are coupled across a tuning stub 78*a*. Connections are made at 52 and 72 to respective air bars 21 and the frame 72. The desired RF field between the respective electrodes 71 and air bars 21 is developed by the oscillator 76 when energized by the DC power supply 75. The RF field is applied to a load 79 between respective electrodes and air bars. The load may be, for example, the web and/or air or other material in the path of or otherwise appropriately located relative to the RF field.

In the RF source 73 may be various meters, for example, meters 77*a*, 77*b* to measure plate voltage and plate current. The measured values from meters 76*g*, 77*a*, 77*b* may be used for monitoring and/or control of the RF source 73.

The above description of the RF source 73 is exemplary, and it will be appreciated that other sources of RF field and/or RF energy may be used to provide the desired operation of the invention to dry webs. Also, although one example of a DC power supply 75 and oscillator is shown in FIG. 7, it will be appreciated that other DC power supplies and/or oscillators may be used to provide suitable electrical energization of and output from the oscillator 76 to obtain the desired RF stray and/or through fields for the purposes described herein.

Figure 9:
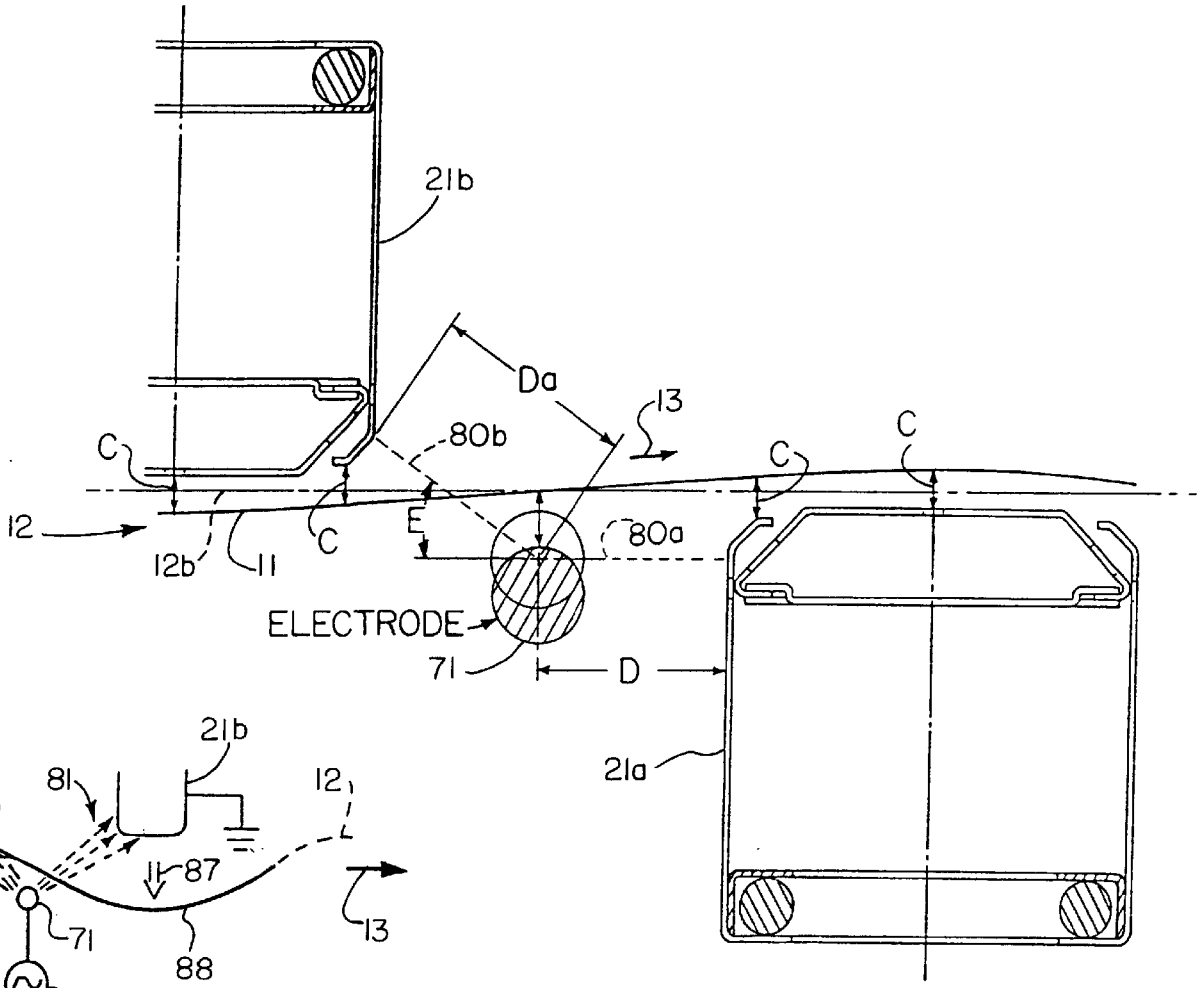
FIGS. 8 and 9 are schematic illustrations of the travel path of a web in a dryer in accordance with the invention, the sinusoidal travel path in FIG. 8 being exaggerated for illustrative purpose and an exemplary air bar being shown in detail in FIG. 9.
Figure 8:
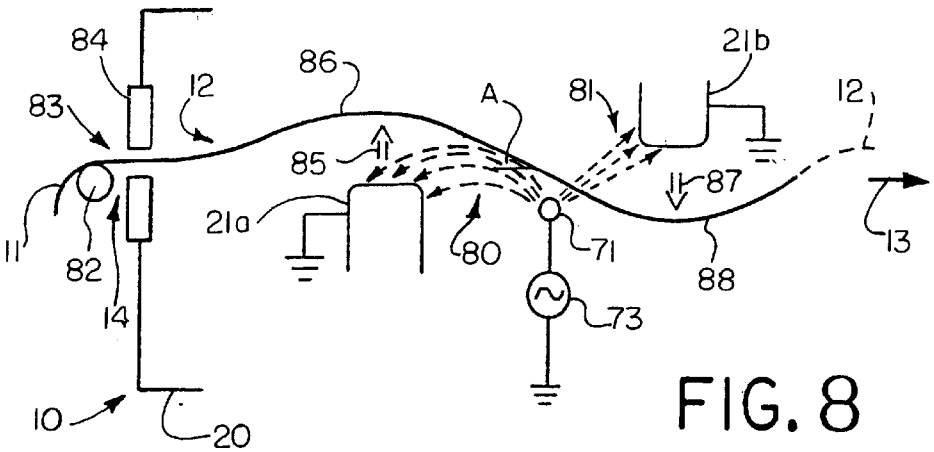

Turning to FIGS. 8 and 9, schematic illustrations show exemplary travel paths 12 of the web 11. Shown in FIG. 8 in exaggerated form is an exemplary sinusoidal travel path 12 of the web 11 relative to an exemplary RF stray field 80 and RF through field 81. The web 11 passes over a feed roll 82 and enters the dryer housing 20 at entrance 83. The entrance 83 includes a seal 84, which may provide thermal seal function and RF seal function preventing the transmitting of thermal energy between the exterior and interior of the housing 20 and preventing leakage of the RF electromagnetic energy from within the housing to the external environment. Exemplary thermal seals may be those used in conventional air flotation oven dryers, and exemplary RF seals may be those used in conventional RF ovens or other devices, microwave ovens or the like.

In the housing 20 a first air bar 21 a directs an air flow 85 toward the web 11 causing a first curved or somewhat sinusoidal hump 86 in the web in an up direction relative to the illustration of FIG. 8. A second air bar 21*b* just downstream along the web path 12 of the air bar 21 a directs an air flow 87 down toward the web 11 causing a second hump 88 in a direction down relative to the illustration. The air flow from air bars 21*a*, 21*b* not only provides support and alignment of the web 11 as it travels along its path 12 through the dryer 10, but also the air flows 85, 87 create a curved, sinusoidal or the like character of the path 12 and web traveling along that path. Considering the path as somewhat of a sinusoidal one, the wavelength depends on the relative spacing of the air bars, and the amplitude of the respective humps 86, 88, for example, depends on the air flows 85, 87, the force and volume with which the flows impinge on the web, web tension provided by various rolls, such as roll 82, feed and take up drives, and possibly other air flows and conditions in the housing 20. As the amplitudes of the half wave humps 86, 88, for example, change, the angle or slope of the web from the horizontal relative to the illustration of FIG. 8 may change. An exemplary angle A in FIG. 8 represents the steepness of the slope of the web 11 approximately in the area where the RF field may impinge on the web.

The angle at which the stray field 80 impinges on the web and the amount of penetration of the stray field into the web can be controlled by controlling the amplitude of the respective half wave humps 86, 88 and by controlling the magnitude and dispersion of the RF stray field 80. Dispersion here refers to whether the RF stray field travels directly, e.g., in a straight line, from the electrode 71 to the air bar electrode 21 a or whether the stray field is distributed over a wider area, such as that represented by the several dashed line arrows in FIG. 8. Some characteristics of the RF field, such as dispersion, magnitude, or intensity, frequency, direction, etc. can be controlled by adjustments in the RF source 73 and location, shape and arrangement of electrodes and air bars, for example. In the illustrated embodiment, if the stray field has relatively small dispersion and the angle A is relatively large, then a relatively small amount of stray field will impinge on the web; in contrast, a relatively small angle A and a relatively large amount of dispersion will result in a relatively larger amount of stray field impinging on the web. Similarly, the extent that the RF through field 81 is distributed in the web 11 as the web passes through that through field can be controlled by controlling the angle A and the dispersion occurring in the RF through field. Other equivalent mechanical, angular, and directional relationships also may be employed to obtain a control of the impingement relationship between the RF field and the web. Therefore, by controlling and coordinating the air flows 85, 87 with the magnitude and dispersion of the respective RF stray field 80 and through field 81, the heating, water releasing, etc. function of the RF fields with respect to the web can be controlled.

In the present invention the air bars may be of a size relatively larger than those used in prior air flotation oven dryers. For example, the approximate length of the air bar in the direction of web travel in prior air floatation dryers was on the order of about 2 inches and in the present invention that length has been enlarged to between about 3.4 to about 6 inches. Also, the air outlet openings, such as the gaps 50, 50' are larger than those used in the past preferably to increase, e.g., to double, the volume of air flow for cooling, heating and removing of moisture emitted from the coating of the web compared to prior air bars.

An example of size, configuration and operation of the air bars 21, 21' is, as follows. The air bars 21 on one side of the web 11 are arranged at a spacing of about 20 inches apart; and a similar spacing is provided between air bars on the opposite side of the web. The air bars on one side of the web are about equally spaced between the air bars on the other side along the web path. This spacing size has been found adequate to provide space to locate two electrodes 71 between the air bars on one side of the web. Other spacing also may be used, as may be desired.

Each air bar has two slot-like gaps 50, respectively near the relatively upstream and relatively downstream edges of the air bar (i.e., relative to direction of web travel). The size of the open gap 50 is on the order of about 0.155 inch. The dimension between gaps 50 is on the order of from about 3.4 inches to about 3.8 inches. These air bars 21 can deliver air flux of about 82 ACFM/sq. ft. at the 20 inch air bar spacing. The air bars 21 deliver air flux at more than twice the air flux of air bars of prior air floatation dryers. Also, the high air flux provided by the present invention air bars is able to carry away moisture from the area of the web at more than twice the rate at which moisture from the area of the web at more than twice the rate at which moisture is emitted; and this further enhances the emitting of moisture from the web.

The dimension of the face 42 of the air bars 21 in the direction of web travel is larger than that dimension for prior air bars, and the width of the gaps 50 in that direction also is about twice as great as that in prior air bars. These characteristics allow for a greater air flux capability than prior air bars. Since according to an embodiment of the invention a primary function of the air flow is to carry away moisture from the area of the web 11 while the RF field provides heating of/for the web, the larger air flux of the invention can be utilized without significantly increasing energy usage to heat more air. Also, since the air may primarily carry away moisture rather than to heat the web, the air impingement area on the web need not be so concentrated or narrow as was required for prior air bars and systems using them; accordingly, compared to prior air bars and systems the relatively large size of the air bar face 42, spacing between gaps 50 of an air bar 21, air flow and air flux provided by the air bars of the invention provide improved operation and efficiency.

Preferably each electrode 71 has enough space in its positioning in the area between air bars to prevent unnecessary arcing to the neighboring air bars 21, plenums, etc., which are grounded. Each air bar 21 has a relatively long height dimension between the air bar face 42 and the opening 34 in the wall 33 of the air bar receiving the support duct 32 from the plenum 24. For example, the distance from the header (plenum) support duct opening 34 to the air bar face 42 may be on the order of from about 5 inches to about 10 inches. The distance between respective electrodes 71 and neighboring air bars 21 on the same or opposite side of the web 11 preferably is adequate so that there is no arcing but there is the desired transmitting of an RF field.

The additional space between air bars compared to the usual spacing of air bars in prior air floatation dryers provides room for increasing the height of the half wave humps 86, 88 in the sinusoidal travel of the web 11 as the air flow thereto is increased; this further increases the control capabilities of the invention, e.g., facilitating control of the manner and extent that the RF stray and/or through field(s) impinge on the web.

Referring to FIG. 9, an enlarged drawing example of the web 11 curvature (sinusoidal or undulating path 12, for example) in relation to an electrode 71 and two air bars 21*a*, 21*b* is shown. A line 12*b* is a straight non-undulating path extending along the length of the dryer housing 20, and the air bars 21*a*, 21*b* and electrode 71 as shown are on respective sides of and do not intersect that line. Therefore, in case the web is moved through the dryer housing when air is not flowing from the air bars, the web ordinarily would not touch the air bars or electrodes. In the illustration of FIG. 9, the web 11 may be maintained spaced about equidistant above or below respective portions of the air bars 21*a*, 21*b*, as is represented, for example, by arrow C (this providing for substantially uniform effect of the air flow thereon); an exemplary distance is from about ¼ inch to about ¾ inch and more preferably from about ⅜ inch to about ⅝ inch. Dimensions D, Da from the electrode 71 to respective air bars 21, 21*a* also may be the same (or different) depending on the desired characteristics of RF stray and/or through fields. Geometrical path lengths for consideration of the RF stray and through fields are represented by lines 80*a*, 80*b*, respectively. The characteristics of such fields may depend on such geometrical considerations, size of parts, e.g., diameter of the electrodes 71, output from the RF source 73, load impedance, etc.

Figure 10:
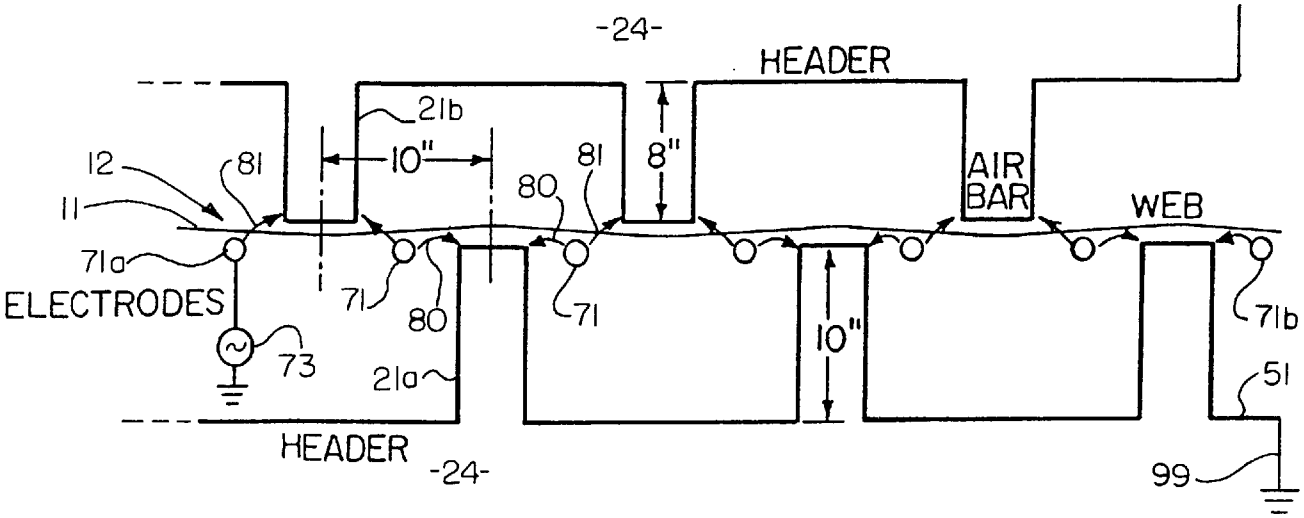
FIG. 10 is a schematic illustration of the geometric or positional relationships of electrodes and air bars providing RF through and stray fields along the web travel path of an exemplary embodiment of dryer.

Referring to FIG. 10, an exemplary schematic arrangement of electrodes 71, air bars 21 and web 11 in a dryer apparatus housing in accordance with the invention is illustrated. Plural air bars 21*a* are located beneath the path 12 of the web 11, and a plurality of air bars 21*b* are located above the path of the web. Electrodes 71 all are located beneath the path of the web 11 and are connected to the RF power generator 73. The web path 12 is somewhat sinusoidal in shape in response to the air flow from the respective air bars. The air bars are supplied with air via the plenum 24. Each of the air bars 21 is coupled to an electrical ground 99. Safety is enhanced because the grounding of the air bars and associated structure to which they are attached or supported avoids the possibility of an operator being electrically shocked and also helps to avoid the possibility of inadvertent leakage of the RF field and of having unintended RF fields in the dryer housing.

In operation of a dryer 10 configured in the manner depicted in FIG. 10, the electrodes 71 direct RF stray fields 80 and RF through fields 81 with respect to the web 11, and the air bars direct air flows with respect to the web 11. A single electrode 71 may provide only an RF through field, only an RF stray field or both an RF through field and an RF stray field, as is shown with respect to the various electrodes illustrated in FIG. 10. It also is evident from FIG. 10 that a single air bar may be used as the ground electrode for one or more electrodes 71 and the RF stray field or through field may be provided by such electrode(s) 71. An electrode 71 may provide only a through field, such as the electrode 71*a* shown at the left-hand side of FIG. 10; an electrode may provide only a stray field, as is shown at 71*b* at the right-hand side of FIG. 10. Also, an electrode may provide both through field and stray field, if desired, as is represented by the five electrodes 71 intermediate of the two end electrodes 71*a*, 71*b* in FIG. 10.

Figure 11:
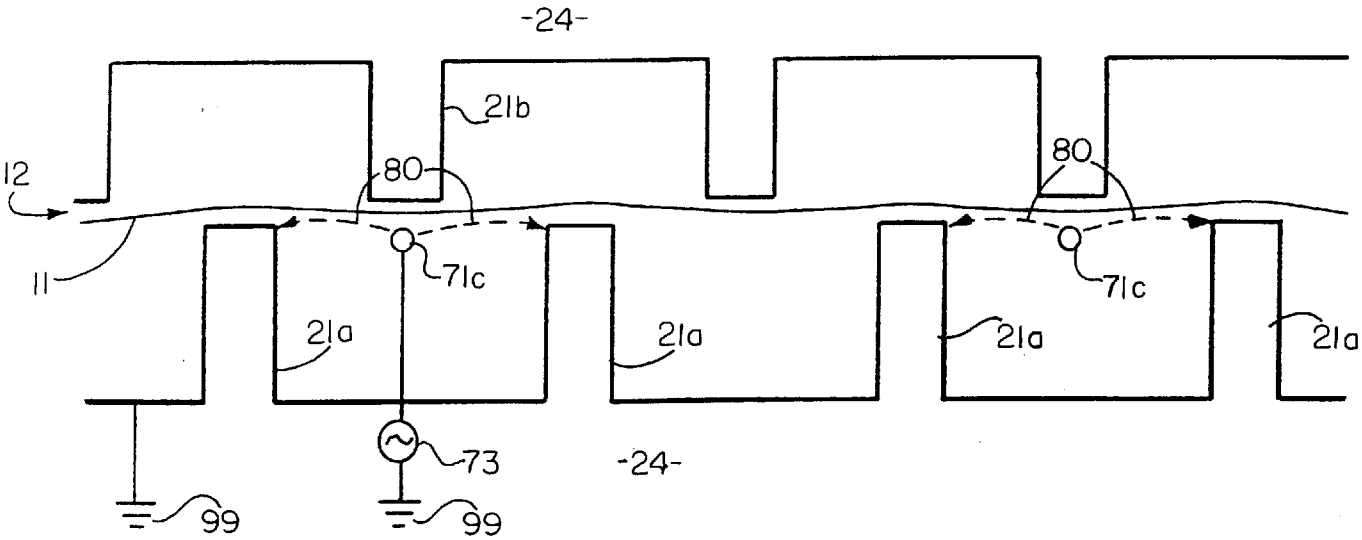
FIG. 11 is a schematic illustration of the geometric or positional relationships of shared electrodes and air bars providing an RF stray field along the web travel path of an alternate exemplary embodiment of dryer.

FIG. 11 is another example of an arrangement of electrodes 71 and air bars 21*a*, 21*b* with respect to a web 11 for a dryer 10 according to the invention. In the embodiment illustrated in FIG. 11 a single electrode 71*c* is shared with and provides with respect to two air bars 21*a* respective RF stray fields. No RF through field is provided to the air bars 21*b*. In this embodiment, if desired, the air bars 21*b* may be electrically non-conductive to avoid a through field being directed with respect thereto.

It will be appreciated that other arrangements of electrodes and air bars may be used to develop and to apply with respect to a web RF stray fields and/or RF through fields. For example, although electrodes 71 are illustrated being positioned only on one side of the web, they also or alternatively may be at the other side of the web. Also, if desired, additional grounded or "hot" electrodes may be used to develop the respective RF fields without relying on or in addition to relying on the air bars to provide grounding or "hot" electrode function.

Figure 12:
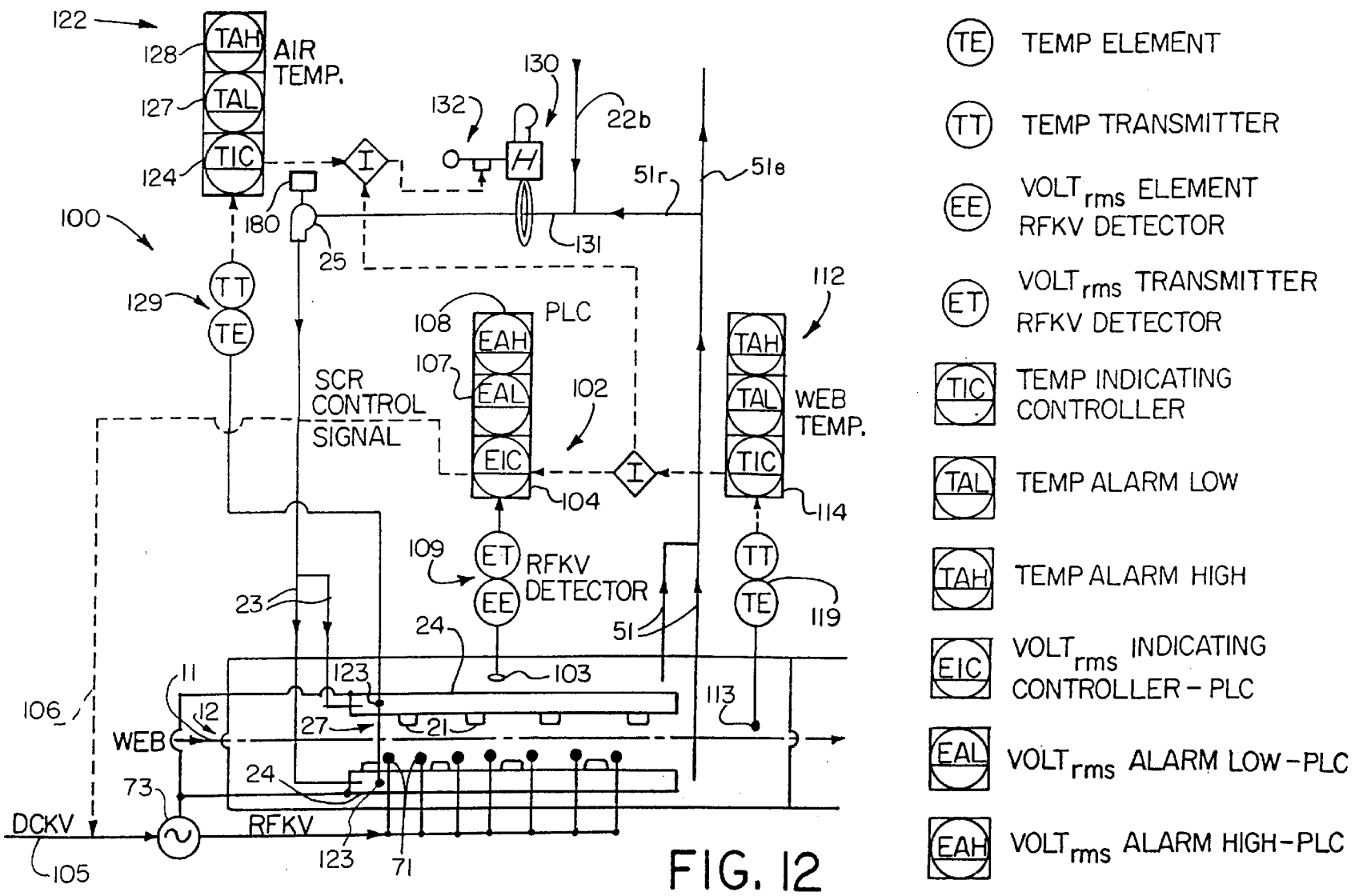
FIG. 12 is a schematic block diagram of sensors and control circuit apparatus and functions used in the dryer.

Referring to FIG. 12, a monitor and control system 100 to provide a number of monitoring and control functions for the dryer 10 is shown. The web 11 travels through a drying zone 27 in the housing 20 of the dryer 10. The system 100 may monitor and control several zones 27, 27*a* or a system 100 may be used for respective zones 27, 27*a*, etc. In the drying zone 27 the air bars 21 direct air flow with respect to the web and the electrodes 71 develop RF stray field and/or RF through field for application with respect to the web. The RF field(s) tend(s) to heat the web and especially the water-containing emulsion coating of the web causing water to be emitted from the coating and the coating, therefore, to be dried. The air flow from the air bars 21 may tend to cool the web or at least to maintain a temperature that avoids blistering conditions and to carry away the emitted moisture. Air flow from the air bars 21 may heat the web, if desired.

The monitor and control system 100 includes an RF detector and control system 102 which detects the magnitude of the RF energy in the drying zone 27. The system 102 includes an RF detector 103, which is described below with respect to FIGS. 13 and 14, and a programmable logic controller (hereinafter referred to as "PLC") 104 which receives an input from the detector 103 and may control the RF power generator circuit 73 and/or the electrical signal delivered to the electrode(s) 71. Such control may be provided by controlling the magnitude of the voltage supplied to the RF power generator circuit 73 from a voltage source, electrical power source or connection there to shown at 105 via a control line 106. The control may be of the power, amplitude, frequency, etc. of the electrical energy and/or circuitry and, thus, of the RF field provided to the web 11. The PLC 104 may be programmed to maintain a substantially constant amplitude of RF field in the drying zone 27 as detected by the detector 103. The PLC 104 may be a PID (proportional, integral, differential) type controller which provides the specified control functions in conventional way. If desired, the RF field may be detected at several locations in the drying zone 27 or at specified locations relative to the zone, and the respective magnitudes detected may be used to control the field at those respective locations, for example, by different respective electrodes 71, which may be coupled to respective attenuating circuits and the RF power generator circuit 73.

The PLC 104 also may include alarm indicators or similar devices 107, 108, which are activated to provide an output or control function in the event the PLC 104 receives a signal from the sensor 103 indicating that the sensed RF field is at an alarm limit that is either too low or too high. The alarm devices 107, 108 may be signal lights or they may be separate transducers and/or controls that may shut down the coating system on account of improper drying occurring in the dryer 10. A transmitter 109 may be used to transmit information from the detector 103 to the PLC 104.

A web temperature detector and control system 112 monitors the temperature of the web 11 and delivers that temperature information as an input to the RF detector and control system 102 and to an air temperature detector and control system 122 described further below. The web temperature detector and control system 11 2 includes a detector or sensor 113, such as a pyrometer device, infrared sensor (e.g., Gentri Model No. ATC-600), thermistor, thermocouple, etc., which is able to detect the temperature of the web 11 and/or the environment immediately adjacent the web, which may acceptably represent the temperature of the web itself. The temperature detector 113 preferably is located at the outlet of the drying zone 27. However, the detector 113 may be located in the drying zone and, if desired, there may be a plurality of detectors for detecting web temperature at more than one location in, beyond, and possibly upstream of the drying zone 27. An electrical signal representing the web temperature as sensed by the detector 113 is delivered to a PLC 114, which may be and operate similar to the PLC 104. The PLC 114 is coupled to alarm limit devices 117, 118, which may be similar to the devices 107, 108, to indicate that a low or high temperature condition exists and/or to effect control in response to the occurrence of such a condition, e.g., by shutting down the web coating line and/or the dryer 10. A transmitter 119 may be used to transmit information from the detector or sensor 113 to the PLC 114.

A signal representing web temperature is directed by the PLC 114 as an input both to the PLC 104 of the RF detector and control system 102 and to the air temperature detector and control system 122. The PLC 104 may respond to the signal from the PLC 114 to provide a control signal on line 106 to increase or to decrease the magnitude of the RF field, for example, thereby to bring the web temperature into the desired range expected at the sensor 113 for proper drying function.

The air flow from supply line or duct 23 into the respective plenums 24 to the air bars 21 is shown in FIG. 12. Also shown in FIG. 12 is the air removal or exhaust line or duct 51. Air is supplied to the plenums 24 above and below the web 11 relative to the illustration in FIG. 12, and air is exhausted from zones above and below the web and is conducted via the exhaust duct 51 for exhausting to the external environment via a flow path 5l*e* or for recirculation (a possible energy saving feature) via flow line or duct 51*r* (also designated 22*c* in FIG. 1). Fresh air (sometimes referred to as make-up air) is provided from line or duct 23*b* for delivery to the supply duct 23 possibly in combination with recirculated air from duct 51*r*.

The air temperature detector and control system 122 includes a temperature detector or sensor 123 in one or both plenums 24 of zone 27, for example. The sensors 123 may be located elsewhere, if desired. The purpose of the sensors 123 is to sense or to detect the temperature of the air flow which is directed with respect to the web 11 by the air bars 21. A signal representing such temperature information is delivered to an air temperature PLC 124, which may be and operate similar to the PLC 104. Associated with the PLC 124 are low and high alarm limit devices 127, 128, which may be similar to the alarm limit indicators 107, 108 and 117, and 118 described above respectively, to provide a visual or audible indication that air temperature conditions are below or above a prescribed alarm limit. The alarm limit devices also or alternatively may provide signals to stop the coating and/or drying process of the coating line and/or dryer 10 in the event a limit condition occurs. A transmitter 129 may be used to transmit information from the detector or sensor 123 to the PLC 124.

The air temperature PLC 124 provides a single to a device 130, which can chill and/or heat the air in line or duct 131. The device 130 may be a chiller that chills the air and/or a heater or burner that heats the air to obtain the desired air temperature for air delivered to the air bars 21 for directing with respect to the web 11. An exemplary device 130 is a Maxon Ovenpak Model 435 with M740 actuator motor for a 3.85 MMBTU/hr. capacity. The signal input to a controller 132 of the device 130 represents a combination of the web temperature signal from the web temperature PLC 114 and the air temperature signal from the air temperature PLC 124. The controller 132 may be a conventional control circuit and/or programming for the device 130 to achieve desired air and web temperature and web drying effected by the dryer 10. An exemplary controller 132 may be a supervisory computer, for example, Allen Bradley PLC5/60 or PLC 5/40.

Although the device 130, the air flow path 131 and supply duct 23 are shown as a single air path leading to the respective plenums 24 at both sides of the web 11, it will be appreciated that several air temperature zones may be created in the drying zone 27. In such case there may be several devices 130 and several supply ducts 23 for delivering air of respective temperatures to respective air bars. In such case there also may be several temperature sensors 123 at selected locations in the drying zone and/or in the plenums or areas of the plenums 24, and respective air temperature PLC's 124 may be used respectively for the individual zones. For example, at the entrance to the drying zone 27 at the left side of FIG. 12, the air may be heated to facilitate raising the web and coating temperature as a supplement to the heating caused by the RF field. At the central portion of the drying zone 27 along the path 12 the air may be chilled to cool the web so a skin is not formed on the coating; and at the outlet of the drying zone 27 (the right side of FIG. 12, for example), the air may be heated again to cause such skin formation and/or to help complete the drying process. This description is exemplary only; it will be appreciated that only cooling, only heating, or different arrangements of cooling and heating portions in the drying zone 27 may be provided.

A control 180 may be provided for the blower 25 in the air flow system 22 of the dryer 10. The control 180 may be adjusted manually to increase or to decrease the amplitude of the sinusoidal half wave humps 86, 88 in the web 11, for example. The control 180 also may be responsive to web temperature, air temperature and/or RF signal strength as detected by the monitor and control systems 102, 112, 122, for example. Increasing or decreasing the air flow may increase or decrease the cooling, heating, and/or moisture removing effect of the air and/or the amplitude of the humps 86, 88 and, thus, the way in which the RF field(s) impinge on the web.

In accordance with the invention control is provided to balance the energy added to the air and provided by the air flow as thermal heat (whether actually raising or lowering temperature of the web) with the amount of RF field provided so that the desired drying or curing occurs and the web temperature does not exceed one which would result in blistering or other heat damage. It has been found that the drying rate in grams of water per square meter of web per second is increased using the present invention, and it also has been found that the speed of web travel through the dryer apparatus 10 can be approximately doubled compared to the speed of prior dryers which use air flotation techniques.

Figure 13:
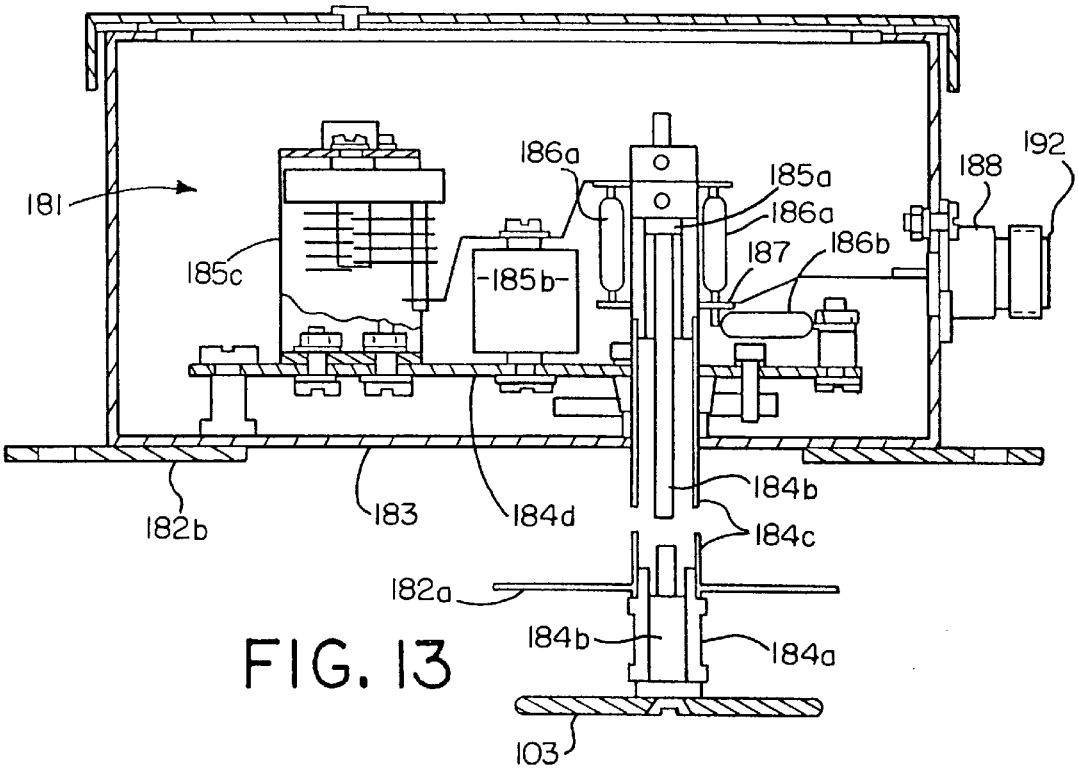
FIG. 13 is a mechanical drawing of an exemplary RF detector and associated circuitry useful in the dryer to provide an input to the control circuit apparatus of FIG. 12, for example.
Figure 14:
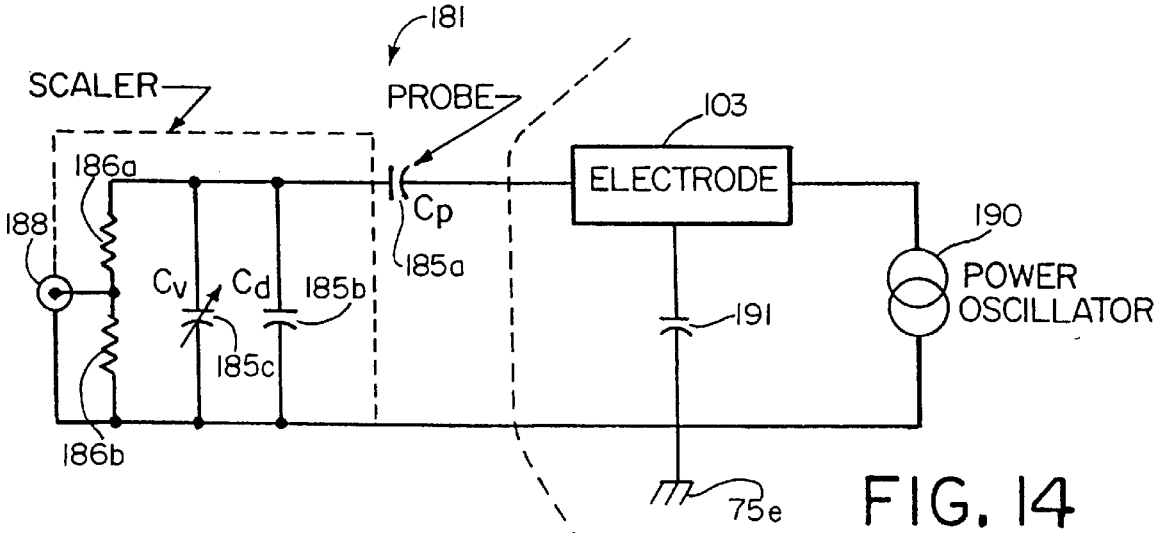
FIG. 14 is a schematic electric circuit diagram of the RF detector.

In FIGS. 13 and 14 are shown schematically an RF sensor 103 and associated detector circuitry 181 for providing to the transmitter 109 of the control circuit 100 a signal representative of the detected RF field in the dryer housing 20. The sensor 103 is through respective walls 182*a*, 182*b* of the oven housing 20. The circuitry 181 is mounted in a box 183, which preferably is made of an RF shielding material.

As is seen in FIG. 13, the sensor 103, which may be of electrically conductive material, is mounted through the walls 182*a*, 182*b* by a non-conductive spacer 184*a*, a conductive plate mount 184*b*, and a ground sleeve 184*c*, which is secured in a panel or plate 184*d*, which itself is conductive and grounded. The sensor 103 and plate mount 184*b* may be considered an electrode. Such electrode 103/184*b* is coupled via an electrode capacitor 185*a* to a pair of capacitors 185*b*, 185*c*, which are coupled in parallel to ground, as is shown in the schematic circuit diagram of FIG. 14. The capacitor 185*b* may be, for example, a fixed capacitor of 25 pf or 50 pf, and the capacitor 185*c* may be a variable capacitor, such as a Hammarlund APC 50. Several resistors 186*a* and resistor 186*b* are connected in series with each other and in parallel across the capacitors 185*b*, 185*c*. The junction (node) 187 of the resistors 186*a*, 186*b* is connected by an electrically conductive strap 187 to the output 188 of the circuitry 181.

Power for the circuitry 181 is provided by a power oscillator 190, which may be a separate oscillator or may be taken as a connection to the oscillator 76 (FIG. 7). A capacitor 191 connection is provided between the electrode 103/184*b* to ground, such as ground 75*e* (FIG. 7).

As was described above, the sensor 103 responds to the RF wave in the dryer housing 20. The circuitry 181 converts that response to an electrical signal which is connected by a connector 192 from the output 188 to the transmitter 109 in the control circuit 100 (FIG. 12) for use as described.

In an example of operation of the invention of dryer 10, for example, the web 11 may travel through the dryer housing 20 of about 120 feet in web travel path or length at a speed of from about 1000 feet to about 1500 feet per minute. Drying time or dwell time may be on the order of between about 4 and about 8 seconds. Also, in accomplishing such operation, air bar 21 to web 11 gap (distance "E" in FIG. 8) may be as small as between ¼ and ½ inch; the air bar length dimension in direction of web travel may be on the order of about 5.25 inches; and spacing between air bars on same side of web is on the order of about 20', e.g., a 10' pitch considering air bars on both sides of the web.

An operating prototype or pilot dryer 10 in accordance with the present invention was constructed and used to demonstrate the principles of operation of the invention. The dryer was constructed in a manner similar to the dryer illustrated in FIGS. 1–3 and elsewhere illustrated and described in the drawings and specification hereof. However, the dryer was smaller in length than a full commercial or industrial dryer that might be used to dry web material at a speed of on the order of 1200–1500 feet per minute. Such a full-scale dryer might be on the order of approximately 120 feet in length having more than two zones, whereas the pilot dryer was approximately 20 feet in length and had only two zones 27, 27*a*, respectively, as are illustrated in FIG. 1.

The web which was dried in three test Runs of the prototype dryer was 40 pound SCK siliconized paper. Chart 1 below summarizes these three test Runs of the pilot dryer to dry the web. Run 1 in the first column of Chart 1 was run at a line speed of 100 feet per minute of the web through the dryer. Runs 2 and 3 were run at 250 feet per minute line speed. Each zone 27, 27*a* was 10 feet long, and the residence time of the web in the dryer, air temperature, air flux, web temperature, and radio frequency field energy in the respective zones during the respective tests are shown in Chart 1.

The nature of the emulsion coating and the quantity in grams per square meter are identified for each Run. The residual moisture weight percent for the webs of the respective Runs also is indicated in Chart 1.

It was found that the dried web product produced during Run 3 resulted in adhesive dryness and performance equivalent to the web product obtained during Run 1. However, as is seen in Chart 1, in Run 3 the web was run at a line speed through the dryer two and one half times the line speed in Run 1; and in run 3 radio frequency energy and air flow were used in the manner described herein in accordance with the invention, whereas in Run 1 only air flow was used to heat and dry the web. Therefore, the pilot dryer and the data obtained and shown in Chart 1 demonstrates the excellent operability of the invention.

Chart 1

| | Run Number | | |
|---|---|---|---|
| | 1 | 2 | 3 |
| Line speed, fpm | 100 | 250 | 250 |
| 57% solid emulsion dry coat weight, gsm | 23.1 | 22.8 | 23.4 |
| Zone-1 | | | |
| length, ft | 10 | 10 | 10 |
| residence time, sec | 6 | 2.4 | 2.4 |
| air temp, degrees F. | 165 | 140 | 100 |
| air flux, ACFM/sq.ft. | 90 | 90 | 90 |
| web temp, degrees F. | 128 | 191 | 195 |
| RF rms KV | 0 | 5 | 7 |

Chart 1-continued

| | Run Number | | |
|---|---|---|---|
| | 1 | 2 | 3 |
| Zone-2 | | | |
| length, ft | 10 | 10 | 10 |
| residence time, sec | 6 | 2.4 | 2.4 |
| air temp, degrees F. | 175 | 190 | 190 |
| air flux, degrees F. | 90 | 90 | 90 |
| web temp, degrees F. | 166 | 183 | 177 |
| RF rms KV | 0 | 5 | 5 |
| Total residence time, sec | 12 | 4.8 | 4.8 |
| Residual moisture weight percentage | 1.0 | 0.95 | 0.85 |

Referring back to FIGS. 1 and 2, the dryer 10 housing 20 is formed in upper and lower housing portions 200, 201. The upper portion is mounted on and supported by the lower portion, and feet 202 support the lower portion on a support pad, floor, etc. The exhaust ducts 51 may be located to exhaust air from the interior chamber 203 of the housing 20. Plural exhaust ducts 51 may exhaust air, respectively, from above and below the web 11 or one exhaust duct may be used. A support bar 204 in combination with support rods 205 (not shown in FIG. 1) support the lower plenum 24 in the housing 20. The frame supports 74 for the electrode frame 72 are mounted on arms 206 which in turn are supported by the support rods 205, plenum 24, and/or other means. The blower 25 blows air through inlet duct 23i to the respective ducts 23 which in turn deliver air to the respective upper and lower plenums 24 seen, for example, in FIG. 2. A support bar 207 and support rods 208 (not shown in FIG. 1) support and mount the upper plenum 24 and air bars 21 above the web.

Referring to FIGS. 1–3 and 15, a compression plate 211 is shown in the dryer apparatus 10. Although the compression plate 211 may be optional, its use may be helpful to reflect RF field to the web 11. In the illustrated embodiment. The dryer apparatus 10 includes respective compression plates 211 between respective air bars 21.

Each compression plate 211 includes a plurality of openings 212 to pass air therethrough. Therefore, air which has been directed out from an air bar 21 toward the web 11, for example, can pass through openings 212 for travel to the exhaust duct 51. In the illustrated embodiment the electrodes 71 are located only below the web path 12 and each compression plate 211 is located below an electrode 71, that is, the electrode(s) 71 is(are) located between a compression plate and the web. If desired, the arrangement and location of compression plates 211 can be changed; for example, there also or alternatively may be one or more compression plates above the web path 12.

Figure 15:
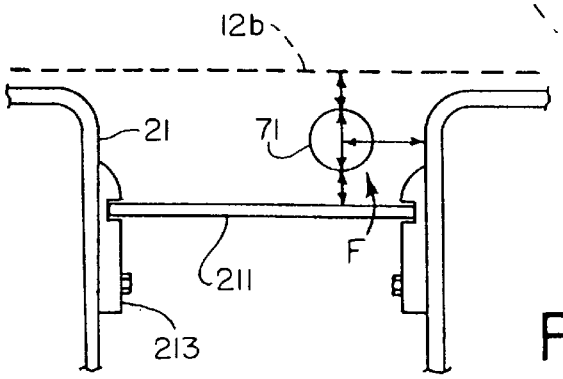
FIG. 15 is a schematic fragmentary elevation view of a compression plate mounted between a pair of air bars.

As is illustrated in FIG. 15, the compression plates 211 may be mounted between neighboring air bars 21 by brackets 213 which are attached by bolts 214, welding, etc. to the air bars. The brackets 213 may be made of conductive material so as to be grounded with the air bars 21 and not to interfere with RF wave reflection. If appropriately designed so as not to affect RF reflection detrimentally, the brackets 213 may be made of another material, even the same material as the compression plates themselves. Exemplary positioning of a single electrode 71 relative to two air bars 21 and a compression plate 211 is shown in FIG. 15. If desired, there is space to locate two electrodes between the air bars of FIG. 15; or the location of the electrode 71 could be moved to be more centered between the air bars. As will be appreciated, other arrangements of air bars and compression plates also may be used to achieve the desired reflection and/or heating functions.

The purpose of the compression plates is to reflect RF energy toward the web to increase the amount of RF energy that is delivered to the web for heating and/or drying. As long as the openings 212 in a compression plate 211 are small relative to the wavelength of the RF electromagnetic energy, the compression plate 211 will be a reflector to increase the amount of RF field directed to the web to effect the drying function. Operation of the reflector plates 211 will depend on a number of factors, such as, for example, the material thereof and/or the various geometrical positioning relationships relative to the air bars, electrodes, and web, several of which are represented by respective arrows "F" in FIG. 15.

The compression plate may be made of dielectric material, which is able to reflect the RF energy without substantial loss. However, the compression plate 211 may be made of a material that has lossy characteristics, and in such case the compression plate may heat in response to RF energy being supplied thereto. Such heat may be used in the drying process. If incidental, relatively undesirable, or unnecessary heating of a compression plate occurs, or even if intended heating occurs, the flowing of air through the opening 212 can help to maintain the compression plate relatively cool so that the heat generated thereby will not detrimentally affect the drying process for the web.

An exemplary compression plate 211 is made of fiberglass reinforced silicone polymer, which has a dielectric constant (at $1*10^6$ Hz) of 4.2 and a dissipation of 0.003. Such material can be purchased from various suppliers and sometimes is referred to as NEMA grade G-7 material. The exemplary compression plate 211 may be ⅛ inch thick, perforated with ½ inch diameter holes, with 30% opening overall provided by the holes for air flow. Other possible exemplary materials which may be available as G-7 material for the compression plate 211 include those sold under the trademarks or tradenames Lexan 500, Lexan 503, and Lexan 3412, each of which has a dissipation factor of 0.0067. These materials may alternatively be laminated on the fiberglass reinforced silicone polymer G-7 compression plate. Another material of which the compression plate may be made is urea formaldehyde. Additionally, to improve the reflection by the compression plate, the G-7 compression plate of fiberglass reinforced silicone polymer or one of the other compression plates mentioned here may be coated with magnesium titanate or barium titanate ceramic powder, which may be printed on the plate; both of these materials have high dielectric constant (e.g., about 13) and a low dissipation factor (e.g., about 0.0012).

In using the dryer 10 in accordance with the present invention a web material 11 having a coating thereon intended to be dried and/or cured is transported through the oven housing 20. A flow of fluid is directed with respect to the web. The flow of fluid may be an air flow directed at the web, parallel to the web, or otherwise angularly with respect to the web, e.g., by air bars 21, and the fluid flow may be of a fluid other than or in addition to air. The fluid flow may provide cooling or heating function. RF stray field and/or RF through field also is provided to the web to heat the material, for example, and thereby to effect drying or curing of the coating. An RF sensor 103 senses the RMS voltage of the RF signal in the drying zone 27 of the dryer, and the signal representing such RMS voltage may be delivered via a proportional, integral, differential controller device, such as a PLC 104 to control the RF energy in the drying zone 27, for example. The RMS voltage is non-linear with respect to the RF heating power in the oven, and, therefore, such controller is useful in response to the sensed signal to provide control of the actual RF energy delivered into the dryer. Monitoring and control of the air temperature using PLC 124 and associated circuitry 122 and monitoring of the web temperature using PLC 114 and associated circuitry 1 12 for use to control air temperature and/or RF field strength, etc., and, for example, therefore, web temperature, also may be provided.

As was mentioned above, the dryer 10 and method of the invention is used to dry various materials, e.g., coatings on webs, and several examples are presented below. The web may be paper, plastic or some other material. The coating may be a water based coating or a solvent based coating. If the coating is water based, the water preferably should have adequate impurities, e.g., salt or other minerals, so as to be responsive to the RF energy or excitation. If the coating is solvent based, preferably the solvent is polar in nature or has polar additives in it, especially if a non-polar solvent, in order to respond to the RF energy or excitation. The moisture, whether water or solvent, contains the coating solids and usually enables the coating to flow for application to and/or distribution on the web.

In one embodiment the coating contains by weight from about 10% solids to about 70% solids. In another embodiment the coating contains by weight from about 50% solids to about 65% solids. In another embodiment the coating contains by weight from about 10% solids to about 30% solids. These are exemplary ranges.

In one embodiment after drying the coating is from about 1 micron to about 130 microns thick. In another embodiment after drying the coating is from about 4 microns to about 30 microns thick. In another embodiment after drying the coating is from about 17 microns to about 27 microns thick. These are exemplary ranges.

The drying flux is the rate at which drying occurs, e.g., the rate at which moisture is eliminated from the coating. Drying flux usually is presented in terms of the quantity of moisture removed from the web per unit of area of the web per unit of time. For example, in prior dryers having multiple drying zones used to dry coatings on webs, the peak drying flux obtained in any of the drying zones was about 3½ grams of water removed per square meter of the web per second ($gm/m^2/sec$). The drying flux may be different in respective drying zones, for example due to the desire sometimes to increase web temperature gradually at first with the lower temperature drying zone having a smaller drying flux than the next downstream drying zone, etc. In prior web dryers the largest average drying flux was on the order of about 1½ $gm/m^2/sec$.

Drying flux of a dryer 10 in accordance with the invention, sometimes referred to as an adhesive oven or adhesive dryer, can be determined in total by measuring the rate of solvent evaporating in the unit space of the oven in grams/second. The solvent may be water or it may be another material. Such measuring can be carried out by measuring the rate of solvent entering the unit space of the dryer with the coated web minus the solvent leaving the unit space with the coated web. The drying flux is found by dividing the rate of solvent evaporation (grams/second) by the product of the web width (meters) and the oven length (meters). This is the average drying flux for the dryer. However, the drying flux through the length of the dryer (adhesive oven) usually varies.

When an adhesive oven (dryer 10) has more than one drying zone, measuring the drying flux for individual zones is more difficult than for the entire oven because it usually is not possible directly to measure the rate of solvent entering and exiting each zone. Two methods have been used to estimate drying flux within a zone of such a multi-zone oven: (a) process air flow humidity measurement and (b) mathematical simulation of the drying process.

For process air flow humidity measurement it is noted that each zone usually has its own independent air handling system to provide air flow into the zone to support the coated web (supply air), e.g., by air bars and air floatation described herein, and air flow out of the zone to remove solvent laden air (return air). The solvent may be water or another material, such as those used in various web coating materials and processes. Humidity ratio (pounds of solvent per pounds of dry air) and volumetric air flow rate (cubic feet per minute) are used to estimate the drying flux. The rate of solvent evaporation in grams/second is found from the amount of solvent being added to the air between the supply air and return air streams. The drying flux is calculated by dividing the rate of solvent evaporation (grams/second) by the product of the web width (meters) and zone length (meters). The zone with the highest drying flux is logically where the peak drying flux occurs.

For mathematical simulation of the drying process a mathematical model to simulate the drying process can be and has been developed. This tool can be used to estimate drying flux by comparing the output of the mathematical model with experimental measurements. A good fit between the mathematical model and the actual measurements indicates that the parameter values used in the model are reasonable. An output of the simulation is drying flux verses oven position.

Four examples of the dryer 10 and method according to the invention to determine the average drying flux as a web is moved at different respective speeds through a dryer that is 120 feet long and has six drying zones each of about 20 feet in length are presented here. The web has a water base coating that is 57% solids when wet, has a dry weight of 23 grams/meter$^2$, has a water content of 23 $gm/mr^2 \times 43\%/57\% =$ 17.4 gm $H_2O/m^2$, and at the exit of the dryer is substantially dry, e.g., contains substantially zero water.

(a) At a web speed through the dryer of 1000 fpm providing web residence time of 7.2 seconds, the average drying flux was:
(17.4 $gm/m^2$ {the water content of the coating before drying}−0 {the water content of the coating after drying})/7.2 seconds=2.41 $gm/m^2$-seconds.

(b) At a web speed through the dryer of 850 fpm providing web residence time of 8.5 seconds, the average drying flux was:
(17.4 $gm/m^2$−0)/8.5 seconds=2.05 $gm/m^2$-seconds.

(c) At a web speed through the dryer of 1250 fpm providing web residence time of 5.76 seconds, the average drying flux was:
(17.4 $gm/m^2$−0)/5.76 seconds=3.02 $gm/m^2$-seconds.

(d) At a web speed through the dryer of 1500 fpm providing web residence time of 4.8 seconds, the average drying flux was:
(17.4 $gm/m^2$−0)/4.8 seconds=3.63 $gm/m^2$-seconds.

If the coating thickness were very small, in fact if it were infinitely small, the drying flux could be very high since there would be an extremely large surface area for the moisture to exit the coating compared to the amount of subsurface coating; and there would be very little moisture below the surface because of the thin characteristic of the coating. However, since the coating has a finite thickness, such as that mentioned above, e.g., from about 1 micron to about 130 microns (after drying), the drying flux is limited at least to an extent that it is undesirable that drying would not cause a substantially moisture-impermeable skin at the surface of the coating that would block moisture from the underlying portions of the coating from exiting the coating during drying.

Using the dryer 10 and method of the invention according to one embodiment a peak drying flux of at least about 3.8 $gm/m^2/sec$. or greater is obtained. According to another embodiment of the invention a peak drying flux of about 4.5 $gm/m^2/sec$ or greater is obtained. According to another embodiment of the invention a peak drying flux of about 5.0 $gm/m^2/sec$ or greater is obtained. According to another embodiment of the invention a peak drying flux of about 6.5 $gm/m^2/sec$ or greater is obtained. According to even another embodiment of the invention a peak drying flux of about 7.0 $gm/m^2/sec$ or greater is obtained. In each of such embodiments, such peak drying flux is provided while the web is maintained substantially free of defects in the coating, such as blistering or other defects that otherwise may be caused by drying.

Using the dryer 10 and method of the invention wherein the dryer includes several zones, according to one embodiment an average drying flux of at least about 2.0 $gm/m^2/sec$. or greater is obtained. According to another embodiment of the invention an average drying flux of about 2.5 $gm/m^2/sec$ or greater is obtained. According to another embodiment of the invention an average drying flux of about 3.0 $gm/m^2/sec$ or greater is obtained. According to another embodiment of the invention an average drying flux of about 3.6 $gm/m^2/sec$ or greater is obtained. According to another embodiment of the invention an average drying flux of from about 2.0 to about 2.5 $gm/m^2/sec$ is obtained. In each of such embodiments, such average drying flux is provided while the web is maintained substantially free of defects in the coating, such as blistering or other defects that otherwise may be caused by drying.

It will be appreciated that by providing the increased drying flux using the invention, the web can travel more rapidly through the dryer and/or can be dried faster than was heretofore possible. According to several embodiments of the invention, the amount of web that can be dried per unit time is increased over the prior dryers; and this is especially true while maintaining the coating substantially free of defects of the type which may occur during drying.

In one embodiment of dryer 10 and method according to the invention the web is satisfactorily dried as it is moved through a dryer having a dryer housing 20 of about 120 feet in web travel path or length at a speed of from about 1000 feet to about 1500 feet per minute. Drying time or dwell time may be on the order of between about 4 and about 8 seconds. According to another embodiment the web travel speed is from about 1,000 to about 1,250 feet per minute. According to another embodiment the web travel speed is from about 1200 to about 1500 feet per minute. According to another embodiment the web travel speed is from about 100 to about 250 feet per minute. In each of such embodiments, such peak drying flux is provided while the web is maintained substantially free of defects in the coating, such as blistering or other defects that otherwise may be caused by drying.

In an embodiment of dryer 10 using the method of the invention the dryer includes six drying zones, the average drying flux is at least about 2.0 $gm/m^2/sec$, the peak drying flux in at least one of the drying zones is at least about 3.8 $gm/m^2/sec$, the coating thickness after drying is on the order of from about 1 micron to about 130 microns, and the dried coating is substantially free of defects.

Using the apparatus 10 and method of the invention coated webs are obtained having a quality such that the coating is substantially free of defects, such as blisters or the like.

With the efficient drying capability of the dryer apparatus 10 and the control functions provided, the dryer 10 can be adjusted easily to effect drying or curing of webs having different coatings and/or coatings that may vary in weight and/or composition. The web stock itself may be paper or polymeric material and the adjustments and controls provided in the dryer apparatus 10 facilitate set up to effect desired drying functions according to those materials. Also, the ingredient removed from the coating or from the web to effect a drying or curing function may be water, solvent, or some other material and/or the curing function may be a chemical reaction type function. All of the foregoing may affect the drying/curing process and by providing the monitoring and control functions of the dryer apparatus of the invention, each of these variations in parameters, materials, etc., ordinarily can be accommodated to achieve desired drying and/or curing efficiently.

An exemplary curing reaction which can be carried out in the dryer 10 using the above-described principles is that known as a hydrosylation reaction. In an exemplary hydrosylation reaction the components are vinyl functional. In an exemplary hydrosylation reaction a silicone oil, such as a vinyl functional polydimethylsiloxane, is cured in the presence of silicon hydride and a catalyst such as platinum in response to heating by the RF field and/or air flow, and the air flow also may be used to maintain temperature to avoid blistering. If desired plural dryers 10 may be used in series, one to provide curing of a silicone coating on a paper web, for example, and a second to dry an emulsion that is applied to the cured silicone coating as the web travels between the two dryers.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. Apparatus for drying/curing a web including a coating thereof, comprising means for directing a web along a sinusoidal path, means for directing fluid flow toward one surface of a web at two locations to urge the web in one direction and for directing fluid flow toward an opposite surface of the web at a location between a pair of the first-mentioned locations to urge the web in a direction opposite such one direction, means for directing RF energy with respect to the web, and said means for directing fluid comprising air bars having a length dimension in direction of web travel on the order of at least about 5.25 inches.

2. The apparatus of claim 1 further comprising means for mounting respective air bars with respect to the path of web travel by only one bolt and a slide bar thereby to minimize interference with such RF energy.

3. Apparatus for drying/curing a web including a coating thereof, comprising means for directing a web along a sinusoidal path, means for directing fluid flow toward one surface of a web at two locations to urge the web in one direction and for directing fluid flow toward an opposite surface of the web at a location between a pair of the first-mentioned locations to urge the web in a direction opposite such one direction, means for directing RF energy with respect to the web, and said means for directing fluid comprising air bars having a spacing between air bars on same side of web on the order of at least about 20".

4. The apparatus of claim 3 further comprising means for mounting respective air bars with respect to the path of web travel by only one bolt and a slide bar thereby to minimize interference with such RF energy.

5. Apparatus for drying/curing a web including a coating thereof, comprising means for directing RF field with respect to a web, including a through field and a stray field, and means for directing fluid flow with respect to the web to prevent blistering.

6. The apparatus of claim 5, said means for directing fluid flow comprising air bars, said air bars being shaped to avoid arcing.

7. The apparatus of claim 6, said shaped air bars being electrically grounded and having smooth ground welds.

8. The apparatus of claim 7, said air bars having round corners.

9. The apparatus of claim 6, said means for directing RF stray field and RF through field comprising a hot electrode, said hot electrode having generally cylindrical shape.

10. The apparatus of claim 5, further comprising a source of electrical energy to provide the RF fields.

11. The apparatus of claim 5, said means for directing fluid flow comprising air bars, a plurality of said air bars comprising electrodes for said means for directing RF field, said means for directing RF field comprising a hot electrode, and wherein all hot electrodes are on one side of the travel path of a web through the apparatus.

12. The apparatus of claim 11, wherein at least one hot electrode is shared with two air bars on one side of the web to provide stray field with respect to both air bars.

13. The apparatus of claim 5, said means for directing fluid flow comprising air bars, a plurality of said air bars comprising electrodes for said means for directing RF field, said means for directing RF field comprising a hot electrode, and wherein at least one hot electrode provides both RF stray field with an air bar on one side of web and RF through field with an air bar located on other side of web.

14. The apparatus of claim 13, wherein at least one hot electrode is shared to provide both stray field with one or more air bars on the same side of the web and a through field with one or more air bars on the opposite side of the web.

15. The apparatus of claim 5, further comprising compression means for reflecting RF field with respect to the web.

16. An air bar for a web drying/curing apparatus, comprising a housing for receiving input air flow, an outlet for distributing the air flow with respect to a web, and smooth curves at the intersections of respective walls of the air bar to avoid arcing when used as an electrode in an RF circuit to provide at least one of a through field and a stray field with respect to the web.

17. The air bar of claim 16, including smooth ground welds to avoid arcing.

18. The air bar of claim 16, including round corners to avoid arcing.

19. The air bar of claim 16, including deburred surfaces to avoid arcing.

20. The air bar of claim 16, wherein the web includes a coating, and further comprising in combination an RF circuit electrically connected to the air bar and operable with the air bar and at least one further electrode to supply an RF flux to the web at a level of from about 1 $KW/m^2$ to about 50 $KW/m^2$ to dry the coating such that the coating is substantially free of defects due to drying.

21. Apparatus for drying/curing a web, comprising means for directing RF energy directly to a web, and reflector means for reflecting RF energy to the web, and said reflector means comprising an RF field compression plate.

22. The apparatus of claim 21, further comprising means for directing fluid flow to the web to cool the web or coating thereof, and openings in said RF field compression plate for passing at least some of such fluid flow therethrough.

23. Apparatus for drying/curing a web, comprising means for directing RF energy directly to a web, and reflector means for reflecting RF energy to the web, and said reflector means comprising an RF field compression plate of a dielectric (substantially non-lossy) so no power is dissipated by such compression plate or reflection therefrom.

24. Apparatus for drying/curing a web, comprising means for directing RF energy directly to a web, and reflector means for reflecting RF energy to the web, and said reflector means comprising an RF field compression plate of a lossy material to add heat to the drying/curing system as well as to reflect RF energy to the web.

25. Apparatus for drying/curing a web including a coating thereof, comprising means for directing RF energy to a web, means for directing fluid to the web, sensor means for sensing the RF energy, and control means for controlling at least one of the RF energy and the fluid based on the sensed RF energy.

26. The system of claim 25, wherein said sensor measures RF field at several locations in the apparatus.

27. The system of claim 25, further comprising means for directing fluid flow with respect to the web, and means for utilizing information sensed by said sensor means to control at least one of power of the RF energy, temperature of the fluid flow, and flow rate of the fluid flow.

28. The system of claim 27, further comprising means for controlling the balance of RF energy and fluid temperature and/or flow rate as a function of the sensor measurements.

29. The system of claim 25, wherein information sensed by said sensor means is used to control overall power expended in the drying/curing process.

30. A system for supplying RF energy to an oven for drying/curing a web, comprising electrodes for delivering RF energy to the web, oscillator means for providing oscillating electrical energy to said electrodes, rectifier means for delivering rectified electrical energy to said oscillator means, sensor means for sensing the RF energy delivered to the web, and feedback control means for controlling the RF energy delivered by said electrodes based on the level of RF energy sensed by said sensor means.

31. Apparatus for drying/curing a web including a coating thereof, comprising a sinusoidal path along which a web is directed, a source of fluid directed toward one surface of a web at two locations to urge the web in one direction and toward an opposite surface of the web at a location between a pair of the first-mentioned locations to urge the web in a direction opposite such one direction, an RF energy source directing RF field with respect to the web to provide at least one of RF stray field and RF through field, and said source of fluid including flow directors comprising air bars having a length dimension in direction of web travel on the order of from about 3.4 inches to about 5.25 inches.

32. Apparatus for drying/curing a web including a coating thereof, comprising a sinusoidal path along which a web is directed, a source of fluid directed toward one surface of a web at two locations to urge the web in one direction and toward an opposite surface of the web at a location between a pair of the first-mentioned locations to urge the web in a direction opposite such one direction, an RF energy source directing RF field with respect to the web, and said source of fluid comprising air bars having a spacing between air bars on same side of web on the order of at least about 20".

33. Apparatus for drying/curing a web including a coating thereof, comprising an RF energy source directing RF field with respect to a web, including a through field and a stray field, and a source of fluid flow directed with respect to the web to prevent blistering.

34. An air bar for a web drying/curing apparatus, comprising a housing means for receiving input air flow, an outlet means for distributing the air flow with respect to a web, and curved surface means at the intersections of respective walls of the air bar to avoid arcing when used as an electrode in an RF circuit to provide at least one of a through field and A stray field with respect to the web.

35. Apparatus for drying/curing a web, comprising an RF energy source directing RF energy directly to a web, and a compression plate reflector reflecting RF energy to the web.

36. Apparatus for drying/curing a web including a coating thereof, comprising an RF energy source directing RF energy to a web, a fluid source directed to the web at least one of to remove moisture emitted from the web, to cool the web, and to balance temperature of the web due to heating by the RF energy, a sensor sensing RF energy, and a control for at least one of the RF energy and the fluid based on the sensed RF energy.

37. A system for supplying RF energy to an oven for drying/curing a web, comprising electrodes delivering RF energy to the web, an oscillator providing oscillating electrical energy to said electrodes, a rectifier delivering rectified electrical energy to said oscillator, an RF energy sensor sensing the RF energy delivered to the web, and a feedback control controlling the RF energy delivered by said electrodes based on the level of RF energy sensed by said sensor.

* * * * *